US010921728B2

(12) United States Patent
Okubo et al.

(10) Patent No.: US 10,921,728 B2
(45) Date of Patent: Feb. 16, 2021

(54) IMAGE FORMING APPARATUS

(71) Applicant: CANON KABUSHIKI KAISHA, Tokyo (JP)

(72) Inventors: Kazuhiro Okubo, Kawasaki (JP); Takahiro Kawamoto, Yokohama (JP); Masanori Tanaka, Yokohama (JP); Takashi Mukai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/579,459

(22) Filed: Sep. 23, 2019

(65) Prior Publication Data

US 2020/0103782 A1 Apr. 2, 2020

(30) Foreign Application Priority Data

Sep. 28, 2018 (JP) ..... 2018-184612

(51) Int. Cl.

| | |
|---|---|
| ***G03G 15/043*** | (2006.01) |
| ***G03G 15/045*** | (2006.01) |
| ***G03G 15/047*** | (2006.01) |
| ***G03G 15/02*** | (2006.01) |

(52) U.S. Cl.

CPC ..... *G03G 15/043* (2013.01); *G03G 15/045* (2013.01); *G03G 15/047* (2013.01); *G03G 15/0266* (2013.01)

(58) Field of Classification Search

CPC ..... G03G 15/0266; G03G 15/043; G03G 15/045; G03G 15/047

See application file for complete search history.

(56) References Cited

U.S. PATENT DOCUMENTS

| | | | | |
|---|---|---|---|---|
| 2011/0026955 | A1* | 2/2011 | Takahashi | G03G 15/043 399/48 |
| 2016/0349657 | A1* | 12/2016 | Nagahashi | G03G 15/0266 |
| 2018/0004113 | A1* | 1/2018 | Mori | G03G 15/0266 |

FOREIGN PATENT DOCUMENTS

| | | | |
|---|---|---|---|
| JP | 2003-232079 | A | 11/2003 |
| JP | 2010-113103 | A | 5/2010 |
| JP | 4854722 | B2 | 1/2012 |
| JP | 2018-4917 | A | 1/2018 |

* cited by examiner

*Primary Examiner* — Joseph S Wong

(74) *Attorney, Agent, or Firm* — Canon U.S.A., Inc. I.P. Division

(57) ABSTRACT

An image forming apparatus includes an image bearing member, a charging member, an exposure unit which performs first exposure to form a non-image portion potential on the electrically charged surface of the image bearing member, and second exposure to form an image portion potential thereon, a developing member, a charging voltage application unit, a current detection unit which detects a current flowing from the image bearing member to the charging member, and a control unit which controls the exposure unit and the charging voltage application unit, wherein, in a case where a current value detected in a predetermined charging voltage application state is a second current value larger than a first current value, the control unit controls the exposure unit to perform image formation with a first exposure amount smaller than that in a case where the detected current value is the first current value.

9 Claims, 19 Drawing Sheets

IMAGE FORMING APPARATUS

BACKGROUND OF THE DISCLOSURE

Field of the Disclosure

Aspects of the present disclosure generally relate to an image forming apparatus, such as a copying machine, a printer, or a facsimile apparatus, which performs image formation with use of an electrophotographic method, and more particularly to an image forming apparatus of the cartridge type, in which a cartridge is attachable to and detachable from a main body of the image forming apparatus.

Description of the Related Art

An image forming apparatus, such as a copying machine or a laser beam printer, forms an electrostatic image (latent image) by radiating light corresponding to image data onto an electrophotographic photosensitive member (photosensitive drum) uniformly charged by a charging unit. Then, the image forming apparatus supplies toner of a developer, which is a recording agent, from a developing device to the electrostatic image, thus making the electrostatic image visible as a toner image. The image forming apparatus transfers, via a transfer device, the toner image from the photosensitive drum to a recording material, such as a sheet of recording paper. The image forming apparatus fixes, via a fixing device, the toner image to the recording material, thus forming a recorded image.

Moreover, as one of charging methods, a contact charging method, which electrically charges the photosensitive drum by applying a voltage to a charging member kept in contact with the photosensitive drum, has been put to practical use because of having advantages in, for example, low ozone and low power consumption. In particular, an apparatus employing a roller charging method, which uses a charging roller as the charging member, is favorable in terms of the charging stability. However, when a voltage is applied to the charging member to perform image formation, an electric discharge occurs in a clearance gap at a charging portion where the photosensitive drum and the charging member are in contact with each other, so that discharge products, such as ozone or nitrogen oxide (NOx), are generated. The discharge products adhering to the surface of the photosensitive drum absorb moisture, thus reducing the electrical resistance of the surface of the photosensitive drum. When a voltage is applied to the charging member in the above state, a minute electric potential other than the potential formation obtained by an electric discharge is formed on the surface of the photosensitive drum. This is caused by injection charging, in which electric charges are injected into the photosensitive drum by the electrical resistance of the surface of the photosensitive drum decreasing separately from the potential formation obtained by an electric discharge. Accordingly, if the discharge products adhere to the photosensitive drum and absorb moisture, it becomes impossible to appropriately form the surface potential of the photosensitive drum, so that image defects may occur.

Therefore, Japanese Patent Application Laid-Open No. 2010-113103 discusses a method which performs current and voltage detection using injection charging, which occurs when potential formation is performed by the contact charging method with discharge products adhering to the photosensitive drum, and determines whether to perform a cleaning operation to remove the discharge products based on a result of such detection.

SUMMARY OF THE DISCLOSURE

However, in the case of performing a cleaning operation based on a result of current and voltage detection in the state in which discharge products adhere to the photosensitive drum, as in the method discussed in Japanese Patent Application Laid-Open No. 2010-113103, there is an issue that productivity may decrease due to the cleaning operation being performed.

Therefore, aspects of the present disclosure are generally directed to preventing or reducing image defects without having to perform a cleaning operation for the photosensitive drum based on a result of current and voltage detection, in an image forming apparatus including a member which is in contact with the photosensitive drum.

According to an aspect of the present disclosure, an image forming apparatus includes an image bearing member configured to be rotatable, a charging member configured to form a charging portion while being in contact with the image bearing member and to electrically charge a surface of the image bearing member at the charging portion, an exposure unit configured to expose, with a first exposure amount, a non-image forming portion, in which a toner image is not formed, in an image formable area of the surface of the image bearing member electrically charged by the charging member, and expose, with a second exposure amount, an image forming portion, in which the toner image is formed, in the image formable area, the first exposure amount being smaller than the second exposure amount, a developing member configured to form a developing portion while being in contact with the image bearing member and to develop the toner image by supplying toner to the image forming portion at the developing portion, a charging voltage application unit configured to apply a charging voltage to the charging member, a current detection unit configured to detect a current value of a current flowing from the image bearing member to the charging member in a state in which the charging voltage is applied at a predetermined value to the charging member, and a control unit configured to control the exposure unit, wherein, in a case where the current value detected by the current detection unit is a second current value larger than a first current value, the control unit controls the exposure unit to expose the surface of the image bearing member with the first exposure amount during image formation smaller than that in a case where the detected current value is the first current value.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. However, for example, the dimension, material, shape, and relative location of each constituent component described in the following exemplary embodiments can be changed as appropriate depending on the configuration of an apparatus to which the disclosure is applied and various conditions therefor. Accordingly, unless specifically described, those are not intended to limit the scope of the disclosure.

First, an image forming apparatus according to a first exemplary embodiment is described in detail with reference to the drawings.

<1. Image Forming Apparatus>

Figure 1:
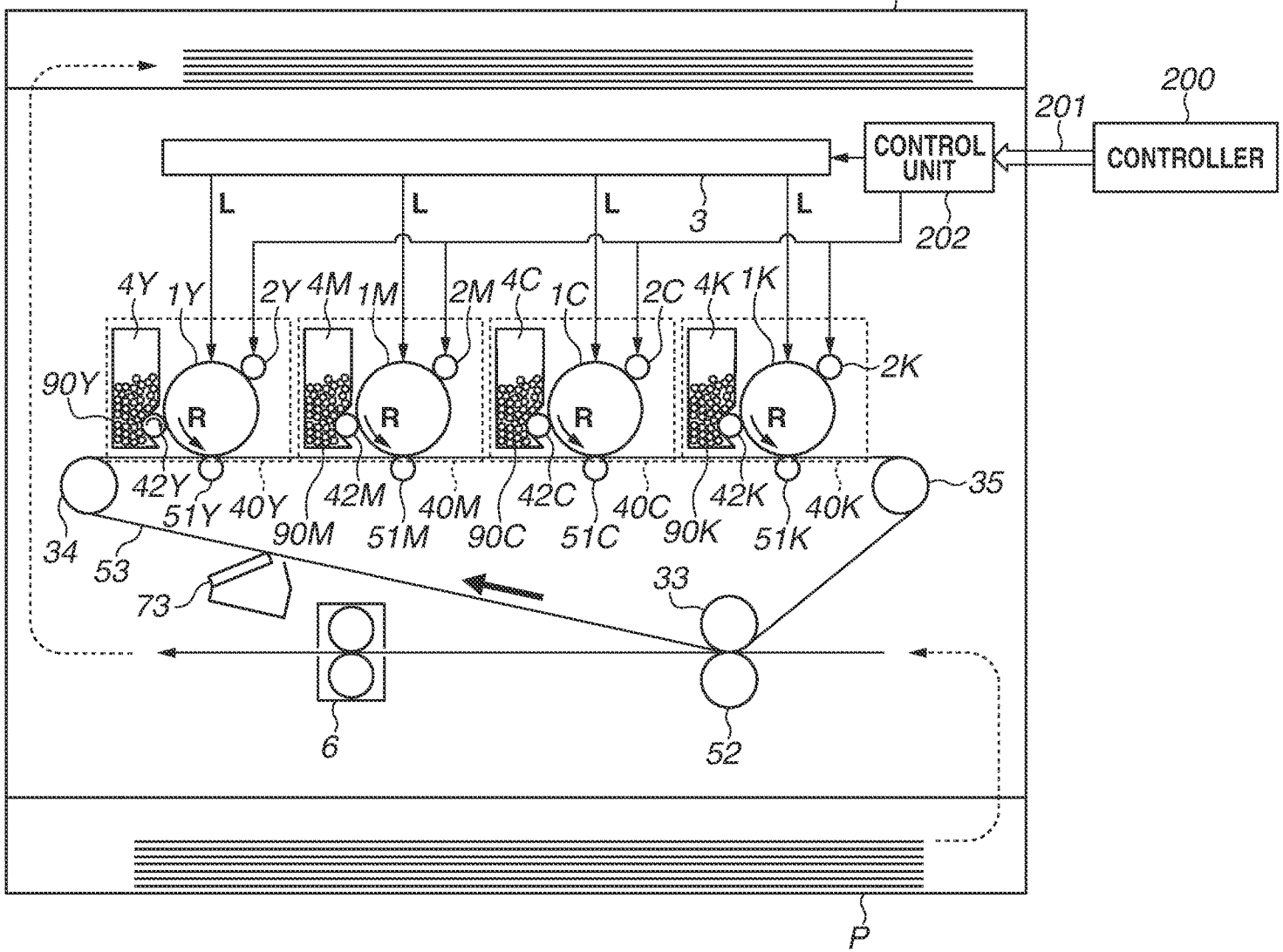
FIG. 1 is a schematic view of an image forming apparatus according to a first exemplary embodiment.

The first exemplary embodiment particularly relates to an image forming apparatus employing the cleanerless system, in which the image forming apparatus is not equipped with a cleaning member serving as a cleaning unit for an image bearing member. FIG. 1 is a diagram illustrating an example of the image forming apparatus 100. In FIG. 1, image forming stations for four colors are illustrated, which are stations for respectively forming images for yellow, magenta, cyan, and black arranged in this order from the left-hand side in FIG. 1. Letters Y, M, C, and K suffixed to reference characters in FIG. 1 represent components of stations for respectively forming toner images for yellow, magenta, cyan, and black on image bearing members. Since configurations of the respective image forming stations are the same except for colors of toners contained therein, with regard to descriptions of the image forming stations, one image forming station is described as a typical example.

A photosensitive drum 1, which is a cylindrical rotatable image bearing member, rotates around the shaft thereof. After the surface of the photosensitive drum 1 is electrically charged uniformly by a charging roller 2, which is a contact charging device, a latent image is formed with a light portion potential V1 on the photosensitive drum 1 by an exposure unit 3, which is an exposure device. The charging roller 2 includes a metal core and a conductive elastic layer formed around the metal core concentrically and integrally therewith, and a charging voltage is applied to the metal core by a charging voltage power source 20, which is a charging voltage application unit. A direct-current (DC) voltage, which includes "Vd+Vth", is applied to the charging roller 2, which then electrically charges the surface of the photosensitive drum 1 in a uniform manner with the charging potential Vd by an electric discharge. Vth denotes a discharge start voltage, and, while, when the charging voltage to be applied is small, the surface potential of the photosensitive drum 1 is not increased by an electric discharge, the surface potential begins to be increased by an electric discharge when the charging voltage reaches the discharge start voltage Vth. In the first exemplary embodiment, the charging voltage to be applied to the charging roller 2 is −1,100 V, the discharge start voltage Vth is −550 V, the charging potential (dark portion potential) Vd is −550 V, and the light portion potential V1 is −100 V.

Toner 90, which is a non-magnetic one-component developer, is contained in a developing container 4, and the toner 90 made to have a predetermined charge polarity is supplied to an electrostatic latent image on the photosensitive drum 1 by a developing roller 42, which is a developing member bearing a developer thereon, so that the electrostatic latent image is made visible as a toner image. The developing roller 42 includes a core metal and a conductive elastic layer formed around the metal core concentrically and integrally therewith, and a developing voltage is applied to the metal core by a developing voltage power source 40, which is a developing voltage application unit. In the first exemplary embodiment, the developing voltage is −350 V. The toner image on the photosensitive drum 1 is electrostatically transferred onto an intermediate transfer belt 53, serving as an intermediate transfer member, by a primary transfer roller 51, serving as a transfer member, to which a transfer voltage is applied by a transfer voltage power source 140, serving as a transfer voltage application unit. The primary transfer roller 51 is configured in a roller shape in which a conductive elastic layer is provided on a shaft, and the transfer voltage is applied to the shaft. The toners 90 for the respective colors are sequentially transferred onto the intermediate transfer belt 53, so that a full-color toner image is formed on the intermediate transfer belt 53. After that, the full-color toner image is transferred to paper P, which is a recording material serving as a transfer-receiving member, by a secondary transfer roller 52, and is then thermally fused and mixed in color to be fixed as a permanent image onto paper P by a fixing unit 6, so that the paper P with the permanent image formed thereon is discharged as an image-formed product.

While the toner image formed on the photosensitive drum 1 is transferred to the intermediate transfer belt 53 by the primary transfer roller 51, a part thereof is not transferred and remains as transfer residual toner on the photosensitive drum 1. The transfer residual toner remaining on the photosensitive drum 1 is toner exhibiting a normal polarity with a small charge amount or inversion polarity toner with charges exhibiting a reverse polarity.

While, in a case where a cleaning member is provided, such primary transfer residual toner is recovered by the cleaning member, in the case of a cleanerless system as in the first exemplary embodiment, there is no cleaning device which recovers primary transfer residual toner. Accordingly, toner on the photosensitive drum 1 directly arrives at the charging roller 2 without being cleaned off. The primary transfer residual toner receives an electric discharge from an electric field generated by a charging voltage at an air gap in front of a charging portion where the charging roller 2 and the photosensitive drum 1 are in contact with each other and is then electrically charged to a negative polarity, which is a normal polarity that is the same polarity as that of the photosensitive drum 1. The primary transfer residual toner is small in charge amount, and is, therefore, easily affected by an electric discharge and is likely to become toner with a negative polarity, which is a normal polarity, due to an electric discharge. Accordingly, at the charging portion, the charging voltage becomes larger in negative value than the surface potential of the photosensitive drum 1, so that the primary transfer residual toner charged to a negative polarity does not adhere to the charging roller 2 but passes by the charging roller 2. On the other hand, inversion polarity toner which does not receive an electric discharge but directly arrives at the charging roller 2 is electrically attracted to the charging roller 2. Such inversion polarity toner is recovered as appropriate by a belt cleaning member 73 performing a cleaning operation described below.

The primary transfer residual toner having passed through the charging portion arrives at a laser-irradiated position in conjunction with the rotation of the photosensitive drum 1. The primary transfer residual toner is not so much as to block laser light emitted from the exposure unit 3, and, therefore, does not affect a process of forming an electrostatic latent image on the photosensitive drum 1 and then arrives at a developing portion, which is a position of contact between the developing roller 42 and the photosensitive drum 1. Toner at a non-exposure portion on the photosensitive drum 1 is electrically recovered to the side of the developing roller 42 due to a relationship between the surface potential of the photosensitive drum 1 and the developing voltage (the dark portion potential (Vd) of the photosensitive drum 1=−550 V, the developing voltage=−350 V). Toner at an exposure portion on the photosensitive drum 1 is not recovered to the developing roller 42 but remains on the photosensitive drum 1 due to a potential relationship between the surface potential of the photosensitive drum 1 and the developing voltage (the light portion potential (V1) of the photosensitive drum 1=−100 V, the developing voltage=−350 V). However, toner 90 is also electrically supplied from the developing roller 42 to an exposure portion on the photosensitive drum 1. Therefore, the primary transfer residual toner becomes usable for transfer again together with the toner 90 supplied from the developing roller 42.

Here, the developing voltage in the first exemplary embodiment is expressed as a difference of electric potential from a grounding potential. Accordingly, the developing voltage=−350 V is interpreted as the developing voltage applied to the metal core of the developing roller 42 having an electric potential difference of −350 V with respect to the grounding potential (0 V). This also applies to the charging voltage and the transfer voltage.

In this way, primary transfer residual toner remaining on the photosensitive drum 1 without being transferred to paper P is recovered to the developing container 4 at a non-exposure portion, and is used for transfer from the photosensitive drum 1 together with toner 90 newly supplied for transfer at an exposure portion. The toner recovered to the developing container 4 is mixed with and used together with toner 90 contained in the developing container 4. Accordingly, with regard to an individual cartridge, it is possible to effectively use toner of color of the individual cartridge.

Moreover, toner transferred to the intermediate transfer belt 53 by the primary transfer roller 51 may also become inversion polarity toner with charges exhibiting a reverse polarity by receiving an electric discharge when passing by the primary transfer roller 51 at a downstream station with respect to the rotational direction of the intermediate transfer belt 53. The inversion polarity toner may electrically adhere to the photosensitive drum 1 at a downstream station as retransferred toner.

To describe retransferred toner, the yellow cartridge 40Y, which is located at the most upstream side, is used. Yellow toner 90Y on the intermediate transfer belt 53, which has been primarily transferred at the yellow cartridge 40Y, passes through a transfer portion which is formed by the photosensitive drum 1 and the primary transfer roller 51, which is a primary transfer position of the cartridge 40M located at the downstream side of the yellow cartridge 40Y. Before passing through the transfer portion, part of the yellow toner 90Y on the intermediate transfer belt 53 is inverted in polarity by an electric discharge in the transfer portion at the primary transfer position of the process cartridge 40M. Then, inversion polarity toner 90Y, which has been inverted in polarity, may shift onto the photosensitive drum 1M due to an electric potential difference between the photosensitive drum 1M and the primary transfer roller 51M. This phenomenon is referred to as "retransfer". In the cleanerless system, in which there is no cleaning member, retransferred toner 90Y, which has shifted onto the photosensitive drum 1M, directly arrives at the charging roller 2M.

If, as with the above-mentioned primary transfer residual toner, the retransferred toner is allowed to pass by the charging roller 2 due to an electric discharge, toner of a different color may enter the developing container 4. This causes toner in a cartridge for a different color, which is other than the primary transfer residual toner on the photosensitive drum 1, to be mixed with toner in another cartridge. If the retransferred toner and toner 90 in the developing container 4 are mixed with each other, color mixture occurs, so that the original color tone may be impaired. Therefore, in the first exemplary embodiment, color mixture is prevented by causing the retransferred toner to temporarily shift to the charging roller 2M. Here, since the charge amount of the retransferred toner is larger at the inversion polarity side as compared with the primary transfer residual toner, the retransferred toner is small in the rate at which the retransferred toner changes into the normal polarity due to an electric discharge. As the influence of inversion caused by an electric discharge is small, the retransferred toner is easily moved to the charging roller 2. Accordingly, the retransferred toner which has been retained by the charging roller 2 electrically adheres to the charging roller 2.

Since, during a printing operation, the charging voltage to be applied to the charging roller 2M is of a negative polarity and the retransferred toner 90Y is of a positive polarity, the toner 90Y retransferred to the photosensitive drum 1M is electrically attracted to the charging roller 2M. In this way, even when image printing is performed in full-color mode, the retransferred toner of the inversion polarity electrically adheres to the charging roller 2, so that color mixture can be prevented or reduced.

The retransferred toner 90Y adhering to the charging roller 2M needs to be once cleaned off at predetermined timing, such as before starting of image formation or after ending of image formation. Therefore, the image forming apparatus 100 performs a cleaning operation to clean the charging roller 2M by electrically returning the toner 90Y, which has been recovered to the charging roller 2M, to the photosensitive drum 1M. Specifically, the image forming apparatus 100 adjusts the charging voltage to the positive polarity side with respect to the surface potential of the photosensitive drum 1M, thus moving the retransferred toner 90Y of the positive polarity to the photosensitive drum 1M. After the toner 90Y is moved to the photosensitive drum 1M, the image forming apparatus 100 adjusts the transfer voltage at the transfer portion to the negative polarity side with respect to the surface potential of the photosensitive drum 1M, thus transferring the toner 90Y to the intermediate transfer belt 53, and then causes the belt cleaning member 73 to recover the toner 90Y thereto.

Furthermore, a similar phenomenon to that in the magenta cartridge 40M also occurs in the process cartridges 40C and 40K, which are arranged at the downstream side of the yellow cartridge 40Y and the magenta cartridge 40M, and, therefore, a description thereof is omitted.

When toner is transferred from the intermediate transfer belt 53 to a recording material P at the secondary transfer roller 52, part of the toner is also not transferred and remains as secondary transfer residual toner on the intermediate transfer belt 53. The secondary transfer residual toner is then removed from the intermediate transfer belt 53 by the belt cleaning member 73 and is discarded to a waste toner container. The belt cleaning member 73 is kept in contact with the intermediate transfer belt 53 at the downstream side of the secondary transfer position in the rotational direction of the intermediate transfer belt 53.

Next, each configuration is described in detail.

The photosensitive drum 1 is configured with a photosensitive material, such as organic photo conductor (OPC), amorphous selenium, or amorphous silicon, provided on a cylindrical drum base substance with a diameter of 24 mm formed from, for example, aluminum or nickel. The photosensitive drum 1 is supported for rotation by the image forming apparatus 100 and is driven by a drive source (not illustrated) to rotate at a process speed of 150 mm/sec in the direction of arrow R illustrated in FIG. 1. In the first exemplary embodiment, the thickness of the photosensitive material is set to 15 μm.

The charging roller 2 is a single-layer roller composed of a conductive metal core and a conductive rubber layer, has an outer diameter of 7.5 mm and a volume resistivity of $10^3$ to $10^6$ Ω·cm, is in contact with the photosensitive drum 1, and is driven to rotate around the conductive metal core in conjunction with the rotation of the photosensitive drum 1. Moreover, the charging voltage power source 20, which is able to apply a direct-current voltage of the negative polarity (charging bias), is connected to the conductive metal core of the charging roller 2.

Figure 2:
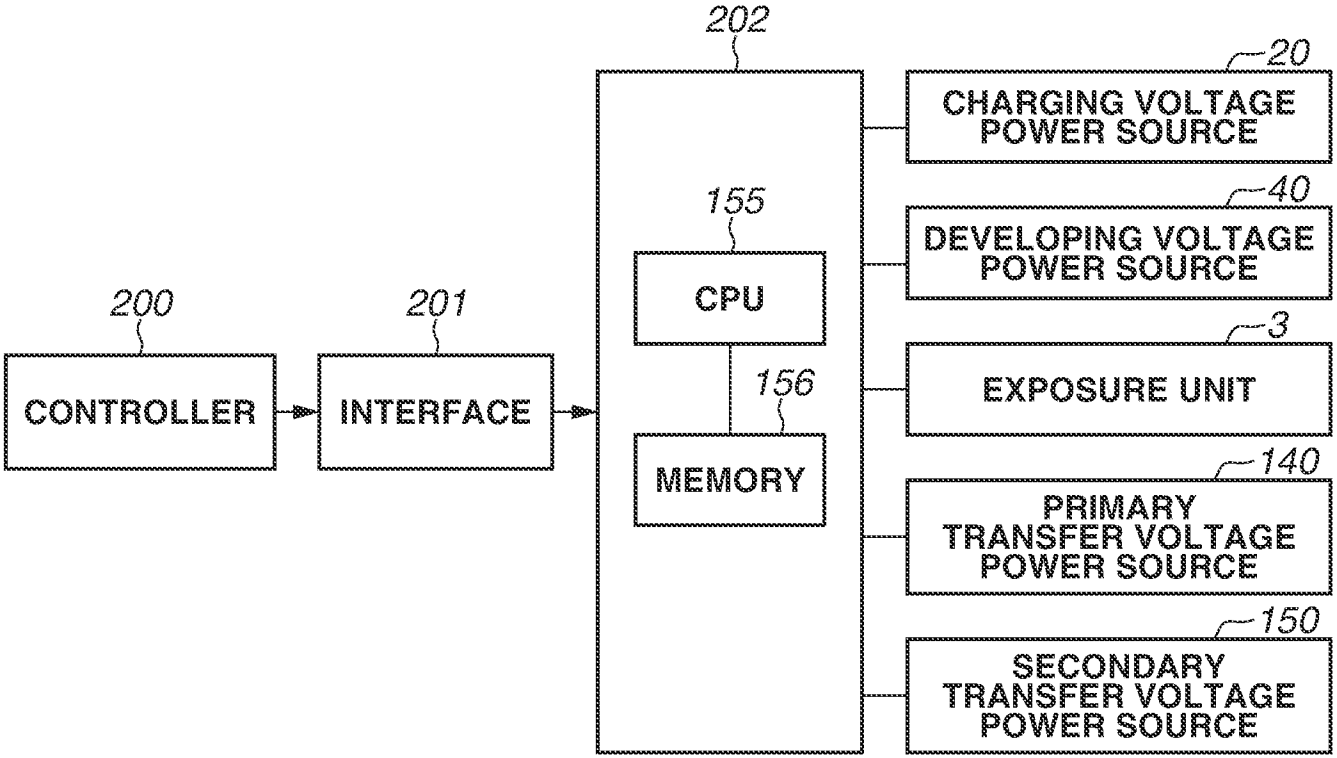
FIG. 2 is a control block diagram according to the first exemplary embodiment.

The exposure unit 3 performs exposure on the photosensitive drums 1Y, 1M, 1C, and 1K, which are respectively arranged in the process cartridges 40Y, 40M, 40C, and 40K. As illustrated in FIG. 2, a time-series electrical digital pixel signal indicating image information, which is input from a controller 200 to a control unit 202 via an interface 201 and is subjected to image processing, is input to the exposure unit 3. The exposure unit 3 includes, for example, a laser output unit, which outputs laser light L modulated according to the input time-series electrical digital pixel signal, a rotational polygonal mirror (polygon mirror), an fθ lens, and a reflecting mirror, and performs main scanning exposure on the surface of the photosensitive drum 1 with the laser light L. The exposure unit 3 forms an electrostatic latent image corresponding to the image information with the main scanning exposure and sub-scanning caused by the rotation of the photosensitive drum 1.

The primary transfer roller 51 is composed of a conductive metal core and semi-conductive sponge, in which a pressure-contact portion for the photosensitive drum 1 contains nitrile rubber (NBR) or epichlorhydrin rubber, which is an elastic body, as a major ingredient, and the resistance adjustment of the primary transfer roller 51 is performed with use of an ion conductive material. The primary transfer roller 51 has an outer diameter of 12.5 mm and a metal core diameter of 6 mm. Moreover, the resistance value of the primary transfer roller 51 during application of 2 kV is 1.0 to $3.0\times10^8$Ω under a normal temperature and normal humidity environment of 23° C. and 50%, is $0.5\times10^8$Ω under a high temperature and high humidity environment of 32° C. and 80%, and is $8.0\times10^8$Ω under a low temperature and low humidity environment of 15° C. and 10%, thus exhibiting a resistance change depending on the environments.

The intermediate transfer belt 53 is located in such a way as to be in contact with the photosensitive drums 1Y, 1M, 1C, and 1K, and has an electrical resistance value (volume resistivity) of $10^{11}$ to $10^{16}$ Ω·cm. The intermediate transfer belt 53 has a thickness of 100 to 200 μm, and is an endless belt formed from a resin film of, for example, polyvinylidene fluoride (PVDF), nylon, polyethylene terephthalate (PET), or polycarbonate (PC). Moreover, the intermediate transfer belt 53 is suspended in a tensioned state by a secondary transfer counter roller 33, a driving roller 34, and a tension roller 35, and is driven to circulate by the driving roller 34 being rotated by a motor (not illustrated). Each primary transfer roller 51 is a roller-shaped member composed of a conductive elastic layer provided on a shaft, is arranged almost in parallel with each photosensitive drum 1, and is kept in contact with each photosensitive drum 1 across the intermediate transfer belt 53 at a predetermined pressing force. A direct-current voltage of the positive polarity is applied to the shaft of the primary transfer roller 51, so that a transfer electric field is formed.

The control unit 202 is a unit which controls an operation of the image forming apparatus 100, and supplies and receives various electrical information signals. Moreover, the control unit 202 performs processing of electrical information signals which are input from various process devices and sensors and processing of instruction signals which are output to various process devices. FIG. 2 is a block diagram illustrating outline control forms of essential portions of the image forming apparatus 100 in the first exemplary embodiment. The controller 200 supplies and receives various pieces of electrical information to and from a host device, and also causes the control unit 202 via the interface 201 to comprehensively control an image forming operation of the image forming apparatus 100 according to a predetermined control program and look-up tables. The control unit 202 is configured to include a central processing unit (CPU) 155, which is a central element that performs various arithmetic processing operations, and a memory 156, including, for example, a read-only memory (ROM) and a random access memory (RAM), which is a storage element. The RAM stores, for example, results of detection by sensors, results of count by counters, and results of arithmetic processing, and the ROM stores, for example, control programs and data tables previously obtained by, for example, experiments. For example, various controlled objects, sensors, and counters in the image forming apparatus 100 are connected to the control unit 202. The control unit 202 supplies and receives various electrical information signals and controls, for example, timing of driving of each unit, thus performing, for example, control of a predetermined image forming sequence. For example, the control unit 202 controls voltages which are applied by the charging voltage power source 20, the developing voltage power source 40, the primary transfer voltage power source 140, and a secondary transfer voltage power source 150 and the amount of exposure which is made by the exposure unit 3. While, in FIG. 1, the control unit 202 is connected to the exposure unit 3 and the charging rollers 2 and there is no indication of connection to the developing rollers 42, the primary transfer rollers 51, and the secondary transfer roller 52, actually, the control unit 202 is connected to those units and controls each unit. Then, the image forming apparatus 100 performs image formation on a recording material P based on an electrical image signal input from the host device to the controller 200. Furthermore, examples of the host device include an image reader, a personal computer, a facsimile apparatus, and a smartphone.

<2. Potential Setting in Image Forming Process>

Next, a potential relationship around the photosensitive drum 1 in an image forming process in the first exemplary embodiment is described.

In the first exemplary embodiment, exposure for image formation is made on the surface of the photosensitive drum 1 which has been electrically charged at the uniform charging potential Vd (dark portion potential: −550 V) by the charging roller 2 with the charging voltage of −1,100 V applied thereto, and the amount of exposure and the exposure region are determined according to an image signal. An image forming portion is exposed by the exposure unit 3 and is then adjusted to be a post-exposure potential V1 (light portion potential: −100 V), which is an image portion potential. A developing voltage Vdc (developing potential: −350 V) is applied to the developing roller 42, which develops a toner image with respect to the post-exposure potential V1 on the photosensitive drum 1.

More specifically, a developing contrast, which is a potential difference between the light portion potential V1 on the photosensitive drum 1 at the image forming portion and the developing voltage Vdc, becomes 250 V, and a back contrast, which is a potential difference between the dark portion potential Vd on the photosensitive drum 1 and the developing voltage Vdc, becomes 200 V. This enables appropriately outputting images such as a solid-black image, a halftone image, and outline characters.

Here, the surface potential of the photosensitive drum 1 and the developing voltage which form the developing contrast and the back contrast are expressed as a potential difference between the surface potential of the photosensitive drum 1 at a portion which is immediately before arriving at the developing portion and the developing voltage which is applied to the developing roller 42. The portion which is immediately before arriving at the developing portion is, specifically, a region on the photosensitive drum 1 between an exposure reaching position on the photosensitive drum 1 of exposure made by the exposure unit 3 illustrated in FIG. 1 and the developing portion.

Here, if image formation is performed without appropriate potential setting being performed, image defects may occur on the recording material P. Specifically, if the developing contrast is small, the amount of toner developed onto the photosensitive drum 1 becomes small, so that a low-density image is generated, and, if the developing contrast is large, the amount of toner developed onto the photosensitive drum 1 becomes large, so that fixing failure occurs. Therefore, the developing contrast needs to be adjusted as appropriate in view of these phenomena.

Moreover, appropriately controlling the back contrast prevents extra toner from adhering to a non-image forming portion (white background portion), which is a portion where image formation is not performed. Such extra toner is referred to as "fogging". If fogging occurs, toner may adhere to other than a portion where image formation is originally intended to be performed and, therefore, a color tone may occur in the white background portion, thus being detrimental to the user. If the back contrast is small, an electric field for keeping toner on the developing roller 42 becomes weak, so that fogging occurs at a non-image forming portion on the photosensitive drum 1. On the other hand, if the back contrast is large, inversion fogging, in which toner 90 electrically charged to the inversion polarity on the developing roller 42 adheres to a non-image forming portion on the photosensitive drum 1, may occur. Accordingly, the back contrast is set in such a manner that fogging becomes least.

Moreover, it is known that the density or the line width varies depending on the back contrast and the developing contrast. Therefore, the back contrast most appropriate for prevention of fogging is set and the developing contrast appropriate for the density or line width is also set, so that, to satisfy these settings, the charging voltage, the developing voltage, and the exposure intensity of the exposure unit 3 are set.

Figure 3:
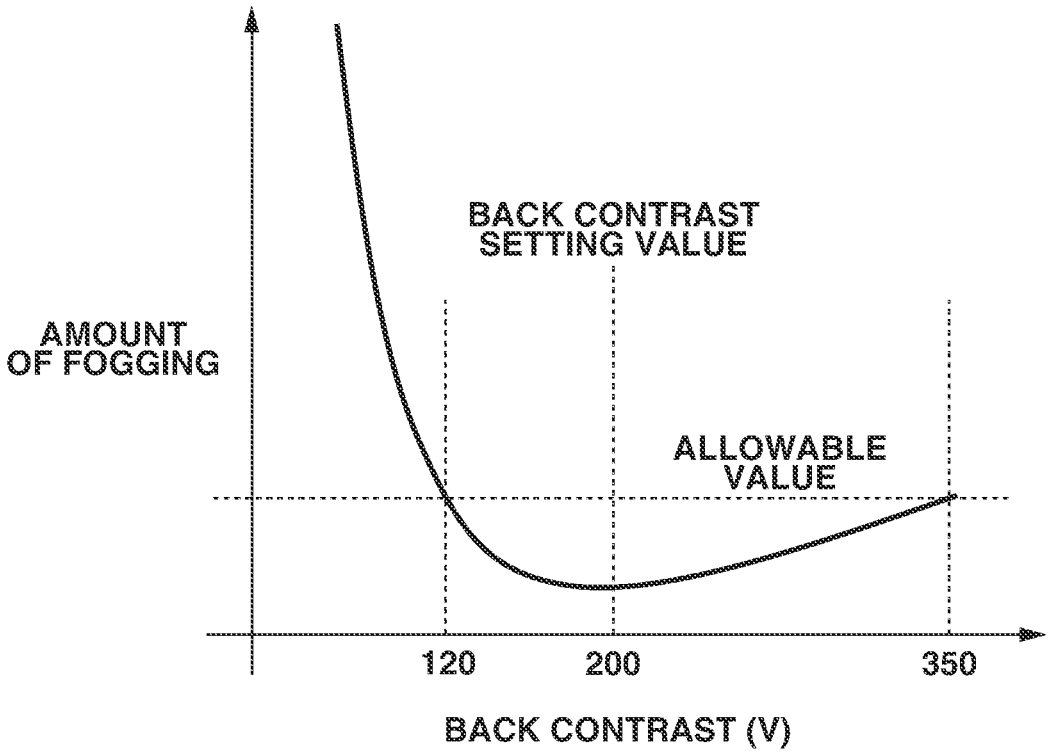
FIG. 3 is an explanatory diagram illustrating a relationship between back contrast and fogging in the first exemplary embodiment.

FIG. 3 illustrates a relationship between the back contrast and fogging. The horizontal axis of the graph indicates the back contrast, and the vertical axis thereof indicates the amount of fogging. With regard to the amount of fogging, toner on the photosensitive drum 1 was taken out by taping with a Mylar tape (polyester adhesive tape), the tape was pasted on reference paper, and, then, the density of the tape was measured by a reflection densitometer (TC-6DS/A) manufactured by Tokyo Denshoku Co., Ltd. With regard to the method of calculating the amount of fogging, an image forming operation was performed with use of the image forming apparatus 100, and the amount of fogging was calculated from the amount of toner on the photosensitive drum 1 obtained when developing was performed while the back contrast was changed without the use of a recording material P. Since, if the amount of fogging is less than or equal to a fixed value, fogging is not visible, so that there is no problem in terms of an image, but, if the amount of fogging increases, fogging becomes visible, so that image defects occur. Therefore, usually, the back contrast is set to such a value that fogging becomes small to the degree of being invisible. In the first exemplary embodiment, as illustrated in FIG. 3, the back contrast is set to 200 V, which is included in a region falling below the fogging allowable value. If the back contrast is set in the range of 120 V to 350 V, that range is a range in which fogging is invisible, and, therefore, in particular, it is favorable that the back contrast is set in the range of 150 V to 250 V.

<3. Influence of Discharge Products on Photosensitive Drum>

Figure 4:
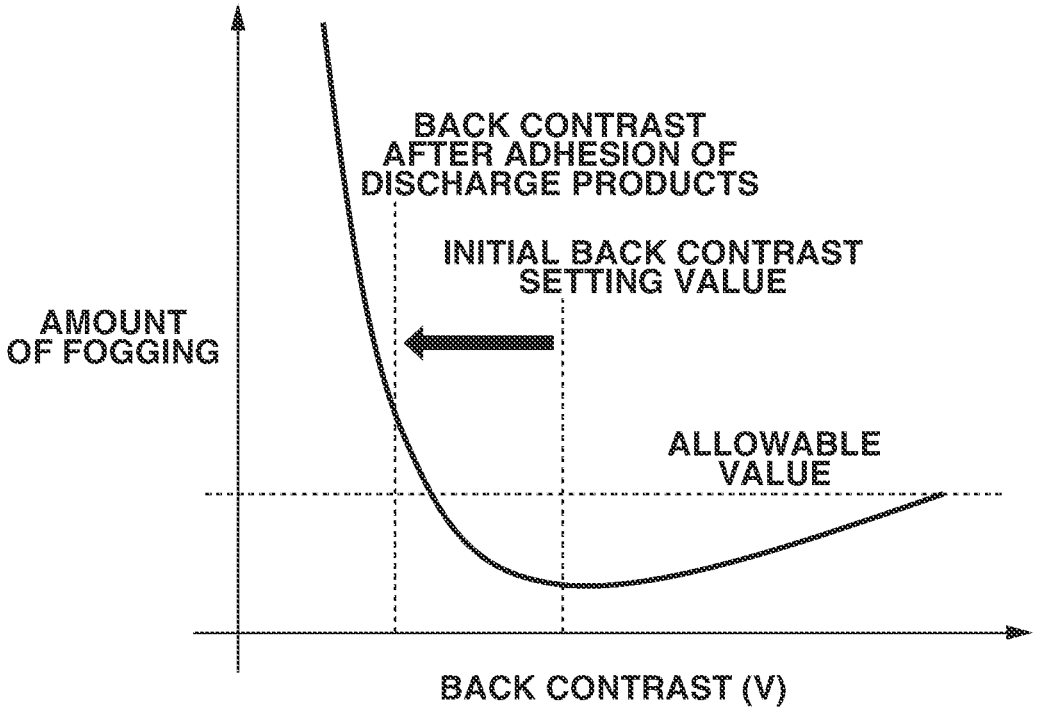
FIG. 4 is an explanatory diagram illustrating a relationship between back contrast and fogging in the first exemplary embodiment.

In performing an image forming operation with use of the image forming apparatus 100, when an electric discharge is performed at the charging roller 2, a few discharge products, such as ozone or NOx, may be generated and adhere to the surface of the photosensitive drum 1. While the discharge products are scraped off by a member which is in contact with the photosensitive drum 1, if the quantity of discharge products adhering to the photosensitive drum 1 is larger than the quantity of discharge products scraped off, the repetitive image forming operation causes discharge products to be gradually accumulated on the surface of the photosensitive drum 1. In particular, in the cleanerless configuration, in which there is no cleaning blade, serving as a cleaning member, on the photosensitive drum 1 as in the first exemplary embodiment, such accumulation becomes more conspicuous. In the contact charging method, as compared with the corona charging method, in which a corona charger is used, the quantity of electric discharges is smaller and the amount of generation of discharge products is smaller. However, since the position of generation of discharge products is a minute air gap between the photosensitive drum 1 and the charging roller 2, even if the amount of generation of discharge products is small, discharge products easily adhere to the surface of the photosensitive drum 1. Then, when adhering to the surface of the photosensitive drum 1, discharge products absorb moisture and thus decrease the electrical resistance of the surface of the photosensitive drum 1, so that the charge retention capability of the photosensitive drum 1 decreases. Then, in a case where a voltage is applied by the contact member, electric charges may be injected into the surface of the photosensitive drum 1. In the developing portion, when negative electric charges at the charging portion formed on the photosensitive drum 1 move to the developing roller 42, which is apparently of the positive polarity with respect to the surface potential of the photosensitive drum 1, the back contrast, which is a potential difference between the photosensitive drum 1 and the developing roller 42, becomes small. Then, as mentioned above, fogging at the developing portion becomes a matter of concern. FIG. 4 illustrates a relationship between the back contrast and fogging obtained when discharge products have been accumulated on the photosensitive drum 1. When, due to, for example, the repetitive image forming operation, discharge products are gradually accumulated on the photosensitive drum 1, the charge retention capability of the photosensitive drum 1 gradually decreases, so that the back contrast gradually transitions in the direction of an arrow illustrated in FIG. 4. This is because, as mentioned above, electric charges on the photosensitive drum 1 flow to the developing roller 42 at the developing portion and the absolute value of the charging potential Vd, which is the surface potential of the photosensitive drum 1, decreases. When the back contrast decreases in association with an increase in discharge products, fogging gradually becomes worse, and eventually exceeds the allowable value and becomes visible.

Therefore, in the first exemplary embodiment, the image forming apparatus 100 measures a current value caused by injection charging and switches a charging voltage which is applied to the charging roller 2, thus preventing or reducing fogging. The method of performing such an operation is described below.

Next, the influence of discharge products on the formation of the surface potential of the photosensitive drum 1 is described.

Figure 5:
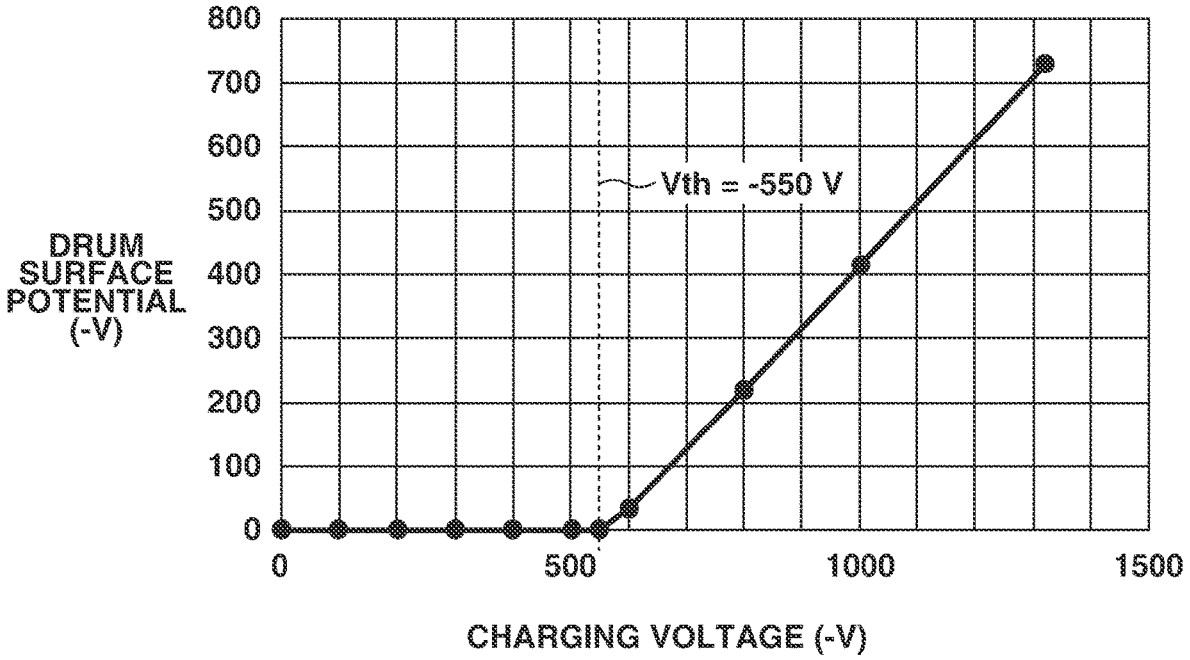
FIG. 5 is an explanatory diagram illustrating a relationship between a charging voltage and a drum potential in the first exemplary embodiment.

FIG. 5 is a graph illustrating results of measuring a relationship between the charging voltage applied to the charging roller 2 and the surface potential of the photosensitive drum 1 under a high temperature and high humidity environment of temperature 30° C. and relative humidity 80%. While, in a case where the absolute value of the charging voltage is small, the surface potential of the photosensitive drum 1 stays unchanged, when the charging voltage exceeds a given voltage value, electric potentials begin to be formed on the surface of the photosensitive drum 1. This voltage value serves as a discharge start voltage Vth. In the first exemplary embodiment, −550 V is set as the discharge start voltage Vth. The discharge start voltage Vth is determined from an air gap between the charging roller 2 and the photosensitive drum 1, the thickness of the photosensitive layer, and the relative permittivity of the photosensitive layer. When a voltage the absolute value of which is greater than or equal to the discharge start voltage Vth is applied to the charging roller 2, a discharge phenomenon occurs at the above-mentioned air gap based on the Paschen's Law, so that electric charges are formed on the photosensitive drum 1.

Figure 6:
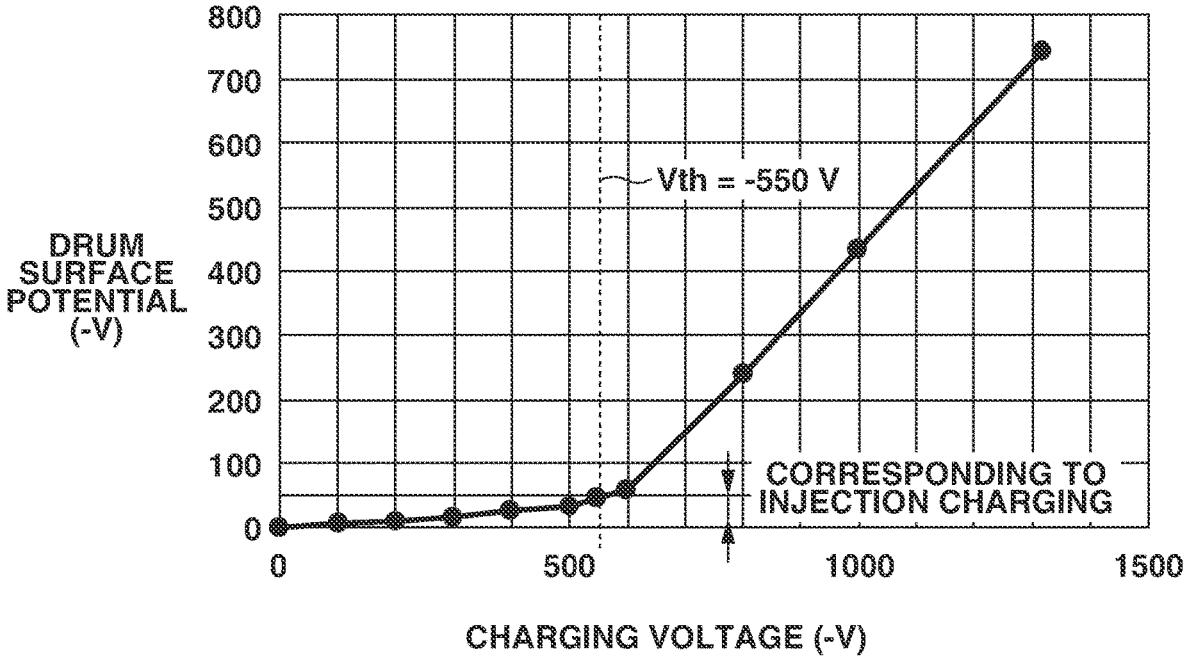
FIG. 6 is an explanatory diagram illustrating a relationship between a charging voltage and a drum potential in the first exemplary embodiment.

FIG. 6 illustrates results of measuring a relationship between the charging voltage applied to the charging roller 2 and the surface potential of the photosensitive drum 1 when the photosensitive drum 1 with discharge products adhering thereto is used under a high temperature and high humidity environment of temperature 30° C. and relative humidity 80%, as with FIG. 5. Since discharge products absorb moisture under a high humidity environment, the electrical resistance of the surface of the photosensitive drum 1 is likely to decrease. Accordingly, unlike the results illustrated in FIG. 5 measured under the same environment, even at the time of an applied voltage the absolute value of which is smaller than the discharge start voltage Vth, electric potentials begin to be formed, so that it can be seen that the electric potential of about −50 V is formed at the time of application of the discharge start voltage Vth. This is because, due to the electrical resistance of the surface of the photosensitive drum 1 with discharge products adhering thereto decreasing and then injection charging being performed, even when a voltage lower than the discharge start voltage Vth is applied, a minute quantity of electric potentials is generated. The amount of such injection charging depends on the quantity of discharge products on the photosensitive drum 1. Accordingly, measuring the amount of injection charging for the photosensitive drum 1 when a charging voltage lower than or equal to the discharge start voltage Vth is applied enables measuring the quantity of discharge products.

<4. Method of Measuring Amount of Injection Charging for Photosensitive Drum by Charging Current Detection>

Figure 7:
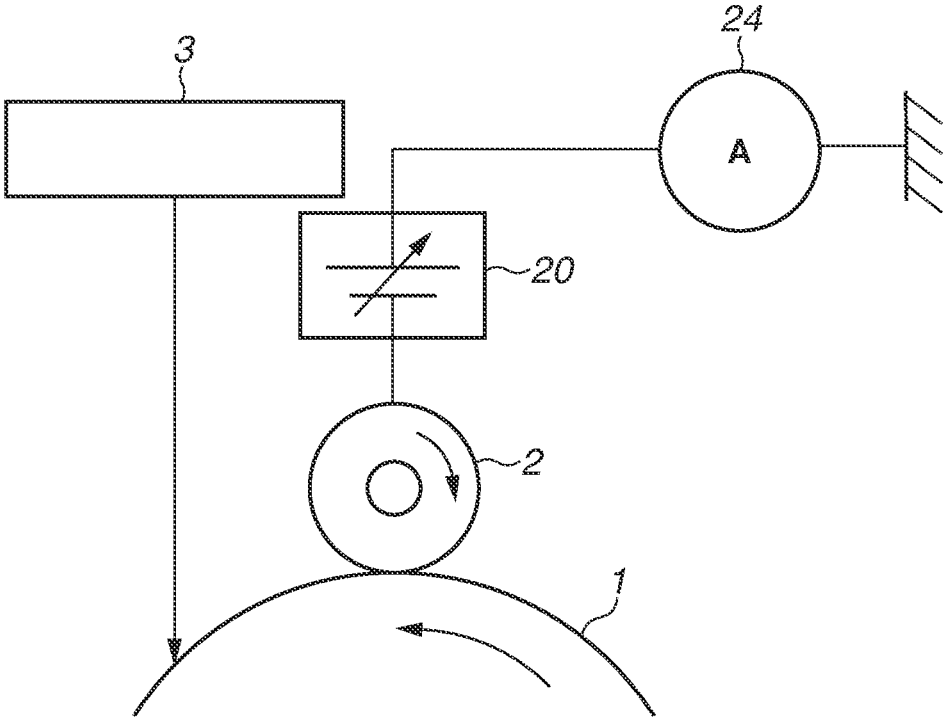
FIG. 7 is a schematic layout view of a current detection unit in the first exemplary embodiment.

The method of measuring the amount of injection charging can include a method of directly checking the surface potential of the photosensitive drum 1 and a method of measuring the current flowing through the charging roller 2. In the first exemplary embodiment, a current measurement circuit 24, which is a more inexpensive configuration, is used. FIG. 7 illustrates a schematic view of constituent elements located around the charging roller 2. The photosensitive drum 1, the exposure unit 3, the charging voltage power source 20, and the current measurement circuit 24 are located around the charging roller 2. The current measurement circuit 24, which is arranged in series with the charging roller 2, is able to detect a current flowing from the photosensitive drum 1 into the charging roller 2 when the charging roller 2 is rotated while being in contact with the photosensitive drum 1.

Figure 8:
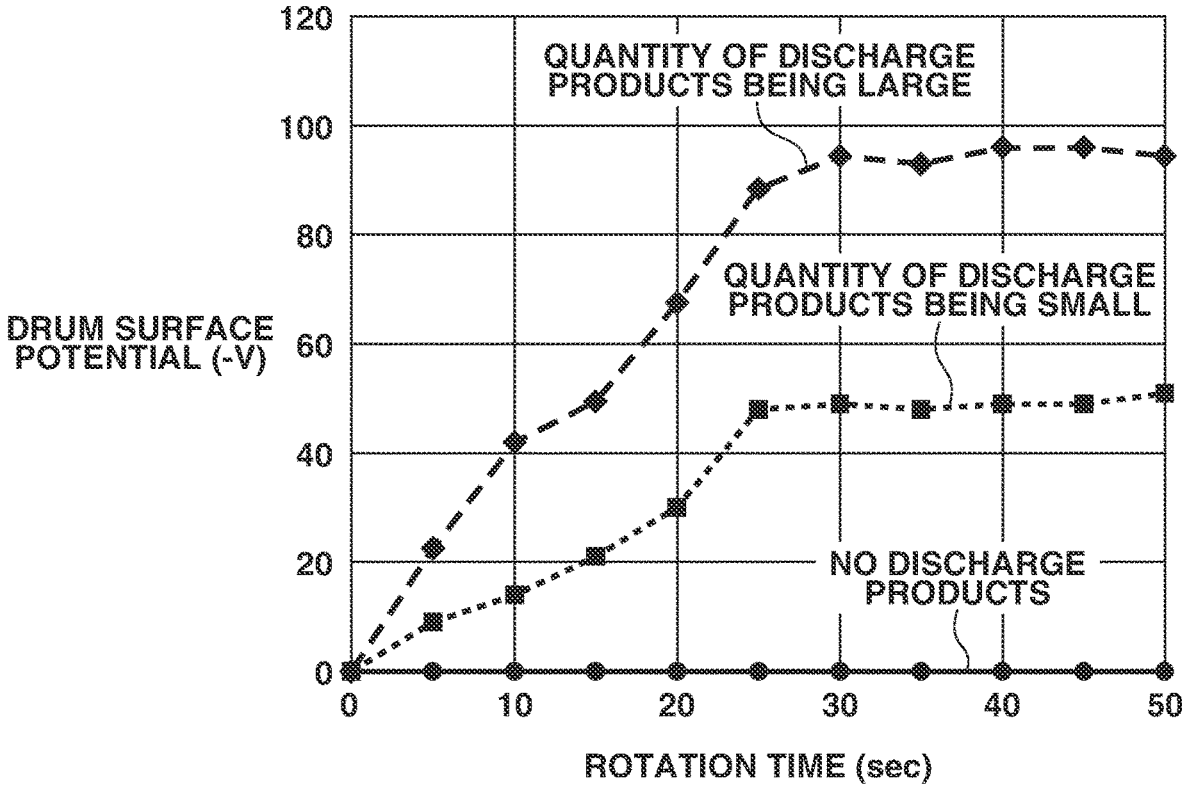
FIG. 8 is an explanatory diagram illustrating a relationship between the quantity of discharge products and an injected potential in the first exemplary embodiment.

The method of measuring the amount of injection charging when a charging voltage the absolute value of which is less than or equal to the discharge start voltage Vth is applied with respect to the photosensitive drum 1 is described with reference to FIG. 8. This method is a method of quantifying the influence of discharge products mainly adhering onto the photosensitive drum 1. FIG. 8 is a graph illustrating the transition of the surface potential of the photosensitive drum 1 obtained when the photosensitive drum 1 is rotated while a direct-current voltage of −400 V, which serves as a voltage the absolute value of which is less than the discharge start voltage Vth, is applied to the charging roller 2.

As illustrated in FIG. 8, injection charging does not occur in the photosensitive drum 1 with no discharge products adhering thereto. Therefore, even when the charging voltage continues being applied while the photosensitive drum 1 is rotated, the surface potential of the photosensitive drum 1 remains 0 V. On the other hand, when discharge products are accumulated on the photosensitive drum 1, the surface potential of the photosensitive drum 1 gradually increases due to injection charging, and, then, the surface potential of the photosensitive drum 1 reaches a saturation point within about 30 seconds. Moreover, when the quantity of discharge products is large, the surface potential of the photosensitive drum 1 reaching a saturation point due to injection charging becomes high.

Since the time taken for the surface potential of the photosensitive drum 1 to reach a saturation point due to injection charging differs depending on the quantity of discharge products, in the first exemplary embodiment, to more accurately detect a difference in the quantity of discharge products, the current measurement circuit 24 is used to measure an integrated current value obtained until injection charging is saturated. When −400 V, which serves as a voltage the absolute value of which is less than the discharge start voltage Vth, is applied to the charging roller 2, injection charging begins and a current begins to flow, so that a current continues to flow until the potential increase caused by injection charging is saturated. Then, when the potential increase caused by injection charging is saturated, a current almost ceases to flow. In the configuration described in the first exemplary embodiment, the injection charging potential reaches a saturation point within about 30 seconds. At this time, measuring an integrated current value, which is obtained by integrating flowing currents, enables measuring the surface potential of the photosensitive drum 1 obtained when injection charging has been saturated.

Table 1 shows a relationship between the surface potential of the photosensitive drum 1 obtained when injection charging has been satisfied (the injection charging potential) and the integrated current value in the first exemplary embodiment. As shown in Table 1, the injection charging potential and the integrated current value have a correlative relationship, so that measuring the integrated current value enables measuring the injection charging potential.

TABLE 1

| | Injection charging potential (−V) | | | | | | |
|---|---|---|---|---|---|---|---|
| | 0 | 25 | 50 | 75 | 100 | 125 | 150 |
| Integrated current value (μA · sec) | 0.0 | 0.4 | 0.8 | 1.1 | 1.5 | 1.9 | 2.3 |

Figure 9:
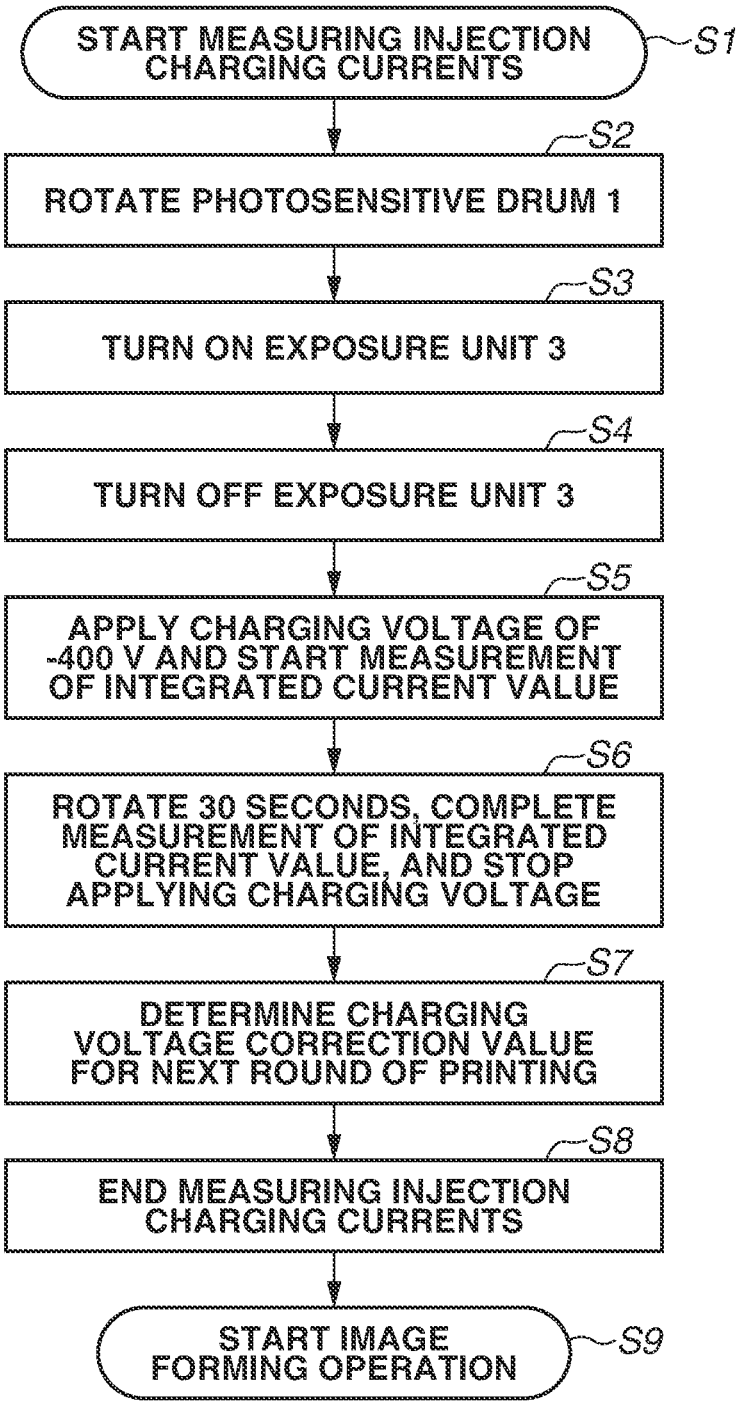
FIG. 9 is an operation flowchart for the image forming apparatus according to the first exemplary embodiment.

FIG. 9 illustrates an example of a flowchart of control for correcting the charging voltage by detecting injection charging currents at the time of non-image formation. Specifically, detection of injection charging currents is performed, for example, when the image forming apparatus 100 has been powered on, when a change in environment has been detected by an environment sensor (not illustrated), or when a halt time elapsing from the last image formation is long. The reason why detection of injection charging currents is performed at such timing is that the resistance of discharge products differs depending on the amount of adhesion of moisture caused by an environment inside the image forming apparatus 100 and, therefore, the state of injection charging for the photosensitive drum 1 differs accordingly. In a case where an inoperative time is long or in a case where the environment has become at high temperature and high humidity, the resistance of discharge products decreases, so that injection charging becomes likely to occur. Accordingly, it is necessary to perform control described in the first exemplary embodiment to particularly perform correction. Alternatively, the control described in the first exemplary embodiment can be sequentially performed during a post-rotation which is performed while image formation is completed and the formed image passes through the fixing unit 6 and is then discharged to outside the image forming apparatus 100.

First, in step S1, the main body power source of the image forming apparatus 100 is turned on, and, in step S2, the control unit 202 rotates the photosensitive drum 1. After that, in step S3, the control unit 202 turns on the exposure unit 3 to perform exposure on the surface of the photosensitive drum 1 and rotates the photosensitive drum 1 at least one rotation to sufficiently lower the potential of the photosensitive drum 1, and then in step S4, the control unit 202 turns off the exposure unit 3. In the first exemplary embodiment, the control unit 202 turns off the exposure unit 3 three rotations of the photosensitive drum 1 after turning on the exposure unit 3. Next, in step S5, the control unit 202 applies a charging voltage the absolute value of which is less than the discharge start voltage Vth, i.e., in the first exemplary embodiment, a charging voltage of −400 V, to the charging roller 2, and starts measurement of the integrated current value. When such voltage setting is performed, if discharge products are accumulated on the photosensitive drum 1, even in a case where a voltage the absolute value of which is less than the discharge start voltage Vth is applied, the surface potential of the photosensitive drum 1 is formed. In step S6, in the above state, the control unit 202 rotates the photosensitive drum 1 for 30 seconds and completes measurement of the integrated current value, and then stops applying the charging voltage. Next, in step S7, the control unit 202 determines a charging voltage correction value for the next round of printing based on the measured integrated current value, and in step S8, the control unit 202 ends the detecting operation. The charging voltage correction value is determined according to a relationship shown in Table 2, and in step S9, the control unit 202 starts an image forming operation.

TABLE 2

| Integrated current value (μA · sec) | Less than 0.4 | Greater than or equal to 0.4 and less than 0.8 | Greater than or equal to 0.8 and less than 1.1 | Greater than or equal to 1.1 and less than 1.5 | Greater than or equal to 1.5 and less than 1.9 | Greater than or equal to 1.9 and less than 2.3 | Greater than or equal to 2.3 |
|---|---|---|---|---|---|---|---|
| Charging voltage correction value (−V) | 0 | 8 | 16 | 24 | 32 | 40 | 50 |

For example, in a case where the measured integrated current value is 1.0 μA·sec, the charging voltage correction value is −16 V. Here, the reason why the relationships shown in Table 1 and Table 2 do not conform with each other is that, while the results in Table 1 are the integrated current values for 30 seconds, the image forming operations to which Table 2 adapts are not provided with such a long charging opportunity. Since the charging voltage in the first exemplary embodiment is −1,100 V, −1,116 V is used as the charging voltage for the next round of printing. At this time, the charging potential Vd becomes about −566 V. Performing such control enables taking account of an amount by which the charging potential Vd decreases when a recording material passes through the developing portion. The circumferential speed ratio of the developing roller 42 to the photosensitive drum 1 during image formation in the first exemplary embodiment is set to 140%, and such a circumferential speed ratio is taken into account. If the circumferential speed ratio becomes larger, it is necessary to set the correction value larger. The circumferential speed ratio is described below in a third exemplary embodiment.

While, in the first exemplary embodiment, a threshold value is set for the integrated current value and the charging voltage is corrected when the integrated current value exceeds the threshold value, the current value and the correction value can be sequentially changed in association with each other. Thus, as the integrated current value is larger, the charging voltage correction value can be set larger.

<5. Advantageous Effect of Charging Voltage Control for Influence of Injection Charging>

Next, effect checking was performed by detecting injection charging currents at the time of non-image formation. Image formation was started with a charging voltage of −1,100 V, and the amount of fogging on the photosensitive drum 1 was measured when an image with a printing ratio of 1% was printed for 5,000 sheets by a two-sheet intermittent printing operation. In the first exemplary embodiment, correction control for the charging voltage was performed in the above-described method at the time of starting of an image forming operation per 1,000 sheets. On the other hand, in a comparative example 1, the image forming operation was directly performed without correction for the charging voltage being performed. Table 3 shows results of fogging corresponding to the numbers of image-formed sheets.

TABLE 3

| Number of image-formed sheets (sheets) | 1000 | 3000 | 5000 |
|---|---|---|---|
| Comparative example 1 | Y | N | N |
| First exemplary embodiment | Y | Y | Y |

In Table 3, "Y" denotes the state in which fogging toner is not visible on the recording material P, and "N" denotes the state in which fogging toner is visible and image defects occur.

With regard to the comparative example 1, as image formation progressed, fogging became worse. This is considered to be because, since discharge products generated by an electric discharge at the charging portion caused by image formation were accumulated on the photosensitive drum 1, the absolute value of the surface potential of the photosensitive drum 1 became small at the developing portion and the back contrast thus became small.

On the other hand, in the first exemplary embodiment, fogging rose to the level in which fogging was not visible from first to last. This is considered to be because, since charging voltage control was performed according to image formation and the value of the charging voltage was changed at appropriate timing, the influence of discharge products was able to be cancelled.

In the first exemplary embodiment, in the image forming apparatus 100, which includes the current measurement circuit 24 that detects information about injection charging in which electric charges are injected from the charging roller 2 to the photosensitive drum 1, the image forming apparatus 100 has the following characteristics. The control unit 202 corrects the charging voltage based on information about injection charging, thus changing the back contrast, which is a potential difference between the surface potential formed on the photosensitive drum 1 immediately before arriving at the developing roller 42 and the developing voltage applied to the developing roller 42. Accordingly, during image formation, in a case where the current value detected by the current measurement circuit 24 is a second current value larger than a first current value, the control unit 202 performs control to make the absolute value of the charging voltage larger than that in a case where the detected current value is the first current value, so that the above-described advantageous effect can be attained.

As described above, according to the method described in the first exemplary embodiment, even when discharge products are accumulated on the photosensitive drum 1, frequent removing operations are not needed and good-quality images with no fogging can be continuously printed.

While, in the first exemplary embodiment, the charging voltage is corrected to keep the back contrast optimum, the developing voltage can be corrected.

Moreover, while, in the first exemplary embodiment, detection of injection charging currents is performed with the charging voltage being applied to the charging roller 2, such detection can be performed with the developing roller 42, which is in contact with the photosensitive drum 1, or the primary transfer roller 51, to which a voltage is able to be applied.

Figure 10:
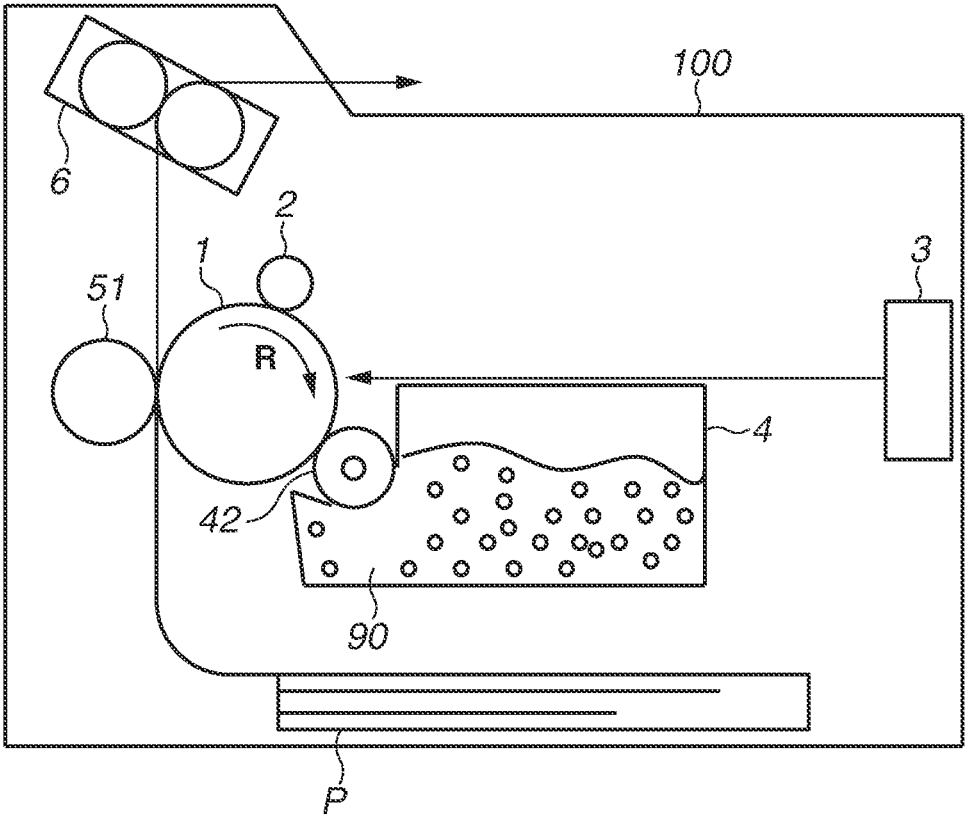
FIG. 10 is a schematic view of an image forming apparatus according to the first exemplary embodiment.

Moreover, as illustrated in FIG. 10, a similar advantageous effect can be attained even when an image forming apparatus including a single image forming unit is used. Additionally, while, in the first exemplary embodiment, a cleanerless system which does not include a cleaning mechanism for the photosensitive drum 1 is employed, a cleaning member such as a cleaning blade can be located on the photosensitive drum 1.

Moreover, while, in the first exemplary embodiment, the amount of adhesion of discharge products is used as information about injection charging, a difference in the surface resistance of the photosensitive drum 1 can be used even when no discharge products adhere to the photosensitive drum 1. For example, a difference in the charging current generated by the film thickness or material of the photosensitive layer of the photosensitive drum 1 differing can be detected.

Moreover, in the first exemplary embodiment, the current measurement circuit 24 is connected to the charging roller 2, but can be connected directly to the photosensitive drum 1 to detect currents. Instead of current detection, the surface potential of the photosensitive drum 1 can be directly measured. In that case, it is desirable to perform measurement at the downstream side of the charging portion in the rotational direction of the photosensitive drum 1, and it is more favorable to perform potential measurement immediately before the exposure portion for exposure on the surface of the photosensitive drum 1.

Moreover, timing of current detection can be during image formation. In the first exemplary embodiment, since current detection is performed at timing other than the time of image formation, a voltage lower than or equal to the discharge start voltage Vth is applied and a current flowing at that time is detected. However, even in a state in which the charging voltage, which causes an electric discharge during image formation, is applied, a combined current of a discharge current and a current caused by injection charging can be detected, so that it becomes possible to detect the state of discharge products. In that case, it is favorable to perform potential measurement immediately before the exposure portion on the surface of the photosensitive drum 1.

Modification Example

While, in the first exemplary embodiment, the charging voltage is corrected to keep the back contrast optimum, the dark portion potential Vd after charging can be adjusted by using the exposure unit 3 to perform weak exposure, in which the amount of exposure is smaller than that at the time of image formation. More specifically, a configuration in which the exposure unit 3 performs normal exposure at a printing portion, forms the light portion potential V1 as a post-exposure potential at an image portion, performs weak exposure at a non-image portion, and forms the dark portion potential Vd as a post-exposure potential at a non-image portion can be employed.

Next, a method of performing non-image portion exposure (weak exposure) is described. The method causes the charging roller 2 with the charging voltage applied thereto to once electrically charge the surface of the photosensitive drum 1 to a post-charging pre-exposure potential the absolute value of which is greater than or equal to the dark portion potential Vd. After that, the method causes the exposure unit 3 to perform weak light emission with respect to the rotational direction of the photosensitive drum 1 to expose the surface of the photosensitive drum 1, thus attenuating (lowering) the surface potential thereof. The method uses not only a charging process but also an exposure process, thus being able to obtain the dark portion potential Vd aimed at. The method enables previously decreasing the surface potential of the photosensitive drum 1 at a portion after the surface of the photosensitive drum 1 passes through the charging portion and before the surface of the photosensitive drum 1 arrives at the developing portion.

Additionally, the present method contributes to the stability improvement of the surface potential of the photosensitive drum 1. Since the discharge start voltage Vth varies depending on the photosensitive layer film thickness of the photosensitive drum 1, if the film thickness of the photosensitive drum 1 decreases due to scraping of the photosensitive drum 1, the dark portion potential Vd may increase. Therefore, it is necessary to adjust the dark portion potential Vd by changing the charging voltage to be applied according to the film thickness of the photosensitive drum 1. More specifically, if the film thickness of the photosensitive drum 1 changes, it becomes difficult to control the surface potential of the photosensitive drum 1. Therefore, the method calculates the film thickness of the photosensitive drum 1 from information related to an electric discharge, such as the number of printed sheets, the number of rotations of the photosensitive drum 1, the charging voltage application time, and the exposure amount and controls the exposure amount according to the calculated film thickness of the photosensitive drum 1, thus being able to perform potential setting. According to the present method, it is possible to stably reproduce the image density, the line width, and the gradation property by only changing the ranges of the strong exposure amount for forming the light portion potential V1 and the weak exposure amount for forming the dark portion potential Vd according to the calculated film thickness of the photosensitive drum 1 without depending on the charging voltage.

Next, the case of correcting the charging voltage by adjusting the weak exposure amount after detecting the integrated current value is described.

For example, as shown in Table 4, in a case where the integrated current value is 1.0 μA·sec, the charging voltage correction value becomes −16 V, and, in the case of correcting the charging voltage with the weak exposure amount, the weak exposure amount is made smaller by 0.0050 $\mu J/cm^2$. At this time, exposure is performed with weak exposure, and the charging voltage to be corrected with the weak exposure amount is fixed to be −1,200 V. When the weak exposure amount for the next round of printing is set as 0.025 $\mu J/cm^2$, which is obtained by making the initial weak exposure amount of 0.030 $\mu J/cm^2$ smaller by 0.0050 $\mu J/cm^2$, the dark portion potential Vd changes from −550 V, which is a value before correction, to about −566 V.

TABLE 4

| Integrated current value (μA · sec) | Less than 0.4 | Greater than or equal to 0.4 and less than 0.8 | Greater than or equal to 0.8 and less than 1.1 | Greater than or equal to 1.1 and less than 1.5 | Greater than or equal to 1.5 and less than 1.9 | Greater than or equal to 1.9 and less than 2.3 | Greater than or equal to 2.3 |
|---|---|---|---|---|---|---|---|
| Weak exposure amount correction value (μJ/cm2) | 0 | −0.0025 | −0.0050 | −0.0075 | −0.0100 | −0.0125 | −0.0150 |

In this way, adjusting the weak exposure amount enables continuously printing good-quality images without fogging formed thereon, without having to perform a frequent removing operation, even when discharge products are gradually accumulated on the photosensitive drum 1. In the first exemplary embodiment, the exposure unit 3 is configured to perform first exposure, in which exposure is performed with a first exposure amount to cause a non-image portion potential with which to form no toner image, and second exposure, in which exposure is performed with a second exposure amount larger than the first exposure amount to cause an image portion potential with which to form a toner image. In the image forming apparatus 100 including the above-mentioned exposure unit 3, the control unit 202 performs the following control.

In a case where, during image formation, the current value detected by the current measurement circuit 24 is a second current value larger than a first current value, the control unit 202 performs control to make the first exposure amount smaller than that in a case where the detected current value is the first current value. This enables attaining the above-described advantageous effect.

Moreover, to adjust the surface potential of the photosensitive drum 1, the control unit 202 can change the charging voltage together with the weak exposure amount. In that case, the control unit 202 performs at least one of control for making the first exposure amount smaller and control for making the absolute value of the charging voltage larger.

Next, a second exemplary embodiment of the present disclosure is described. The basic configuration and operation of the image forming apparatus according to the second exemplary embodiment are similar to those of the first exemplary embodiment. Accordingly, in the image forming apparatus according to the second exemplary embodiment, elements having functions or configurations identical to or corresponding to those of the image forming apparatus according to the first exemplary embodiment are assigned the respective same reference characters as those in the first exemplary embodiment, and the detailed description thereof is omitted here.

<1. Method of Predicting Quantity of Discharge Products>

In the second exemplary embodiment, the method, described as follows, predicts the quantity of discharge products with use of a time for which the charging voltage has been applied to the charging roller 2 and a time for which the developing roller 42 has been driven while being in contact with the photosensitive drum 1. The method keeps the back contrast appropriate based on a predicted result.

Discharge products on the photosensitive drum 1 are generated by an electric discharge and are gradually accumulated thereon. Since the generation of discharge products is dominated by a generation caused by an electric discharge at the charging portion, measuring a time for which the charging voltage has been applied to the charging roller 2 and the magnitude of such a charging voltage enables predicting the quantity of discharge products which have adhered to the photosensitive drum 1. On the other hand, in the second exemplary embodiment, since the developing roller 42 is in contact with the photosensitive drum 1 while having a circumferential speed difference therefrom, an advantageous effect in which the accumulated discharge products are scraped off by the developing roller 42 is attained. Therefore, measuring a time for which the developing roller 42 is rotating while being in contact with the photosensitive drum 1 enables predicting the quantity of discharge products scraped off from the photosensitive drum 1. Using these phenomena enables predicting the quantity of discharge products accumulated on the photosensitive drum 1. In the second exemplary embodiment, when the surface movement speed of the photosensitive drum 1 is denoted by V1 and the surface movement speed of the developing roller 42 is denoted by V2, V2/V1 is set to 1.4. In other words, the developing roller 42 rotates at a surface movement speed of 140% with respect to the photosensitive drum 1. Hereinafter, this state is described as "the circumferential speed ratio being 140%".

When an accumulated time for which the charging voltage has been applied to the charging roller 2 is denoted by T (seconds) and an accumulated time for which the developing roller 42 has rotated while being in contact with the photosensitive drum 1 is denoted by C (seconds), the CPU 155, which serves as an acquisition unit, performs counting of T and C. Here, with regard to the accumulated time for which the charging voltage has been applied, unless an electric discharge occurs between the photosensitive drum 1 and the charging roller 2, no discharge products are generated. Accordingly, the accumulated time T is interpreted as a time for which charging voltages higher than or equal to the voltage which causes an electric discharge have been applied. In the second exemplary embodiment, for example, the charging voltage application time T for printing of only one sheet is 6 seconds, and the contact rotation time C of the developing roller 42 is 4 seconds.

Then, the CPU 155 calculates a discharge product predictive quantity H as:

$$H=(A\times T-B\times C)\times P \quad (1)$$

Here, the values A and B are coefficients for correcting a difference between the quantity of accumulated discharge products and the quantity of scraped-off discharge products. P denotes the number of continuous printing operations (in the case of one-sheet intermittent printing, the number of image-formed sheets). The value A depends on parameters related to generation of discharge products, and is, therefore, determined depending on information about the film thickness of the photosensitive drum 1, the charging voltage to be applied to the charging roller 2, and the transfer voltage to be applied to the primary transfer roller 51. The value B depends on parameters related to scraping-off of discharge products, and is, therefore, determined depending on the composition and hardness of the developing roller 42, the surface movement speed of the developing roller 42, the circumferential speed difference of the developing roller 42 from the photosensitive drum 1, the type of toner 90, and the amount of application of toner 90 on the developing roller 42. The values A and B are values experimentally obtained with use of a plurality of photosensitive drums 1, and, in the second exemplary embodiment, the value A is set to 2 and the value B is set to 1. The value A being larger indicates the amount of generation of discharge products being larger, and the value B being larger indicates the amount of scraping-off of discharge products being larger. This enables obtaining the discharge product predictive quantity H. Then, the CPU 155 determines the correction value for the charging voltage based on the value of the discharge product predictive quantity H calculated by formula (1) with use of Table 5. For example, in a case where images have been printed on 1,000 sheets of recording material P in the one-sheet intermittent printing mode, the value of the discharge product predictive quantity H becomes $H=(2\times6-1\times4)\times1000=8000$. In the case of H=8000, the charging voltage correction value becomes −8 V based on Table 5. Since the charging voltage in the second exemplary embodiment is −1,100 V, −1,108 V is set to be applied as the charging voltage for the next round of printing. At this time, the dark portion potential Vd becomes about −558 V.

The acquired value acquired as the discharge product predictive quantity H becomes smaller as the rotation time of the developing roller 42 is longer in a case where the application time of the charging voltage is a fixed value, and becomes larger as the application time of the charging voltage is longer in a case where the rotation time of the developing roller 42 is a fixed value.

TABLE 5

| Discharge product predictive quantity H | Less than 5,000 | Greater than or equal to 5,000 and less than 10,000 | Greater than or equal to 10,000 and less than 15,000 | Greater than or equal to 15,000 and less than 20,000 | Greater than or equal to 20,000 and less than 25,000 | Greater than or equal to 25,000 and less than 30,000 | Greater than or equal to 30,000 |
|---|---|---|---|---|---|---|---|
| Charging voltage correction value (−V) | 0 | 8 | 16 | 24 | 32 | 40 | 50 |

While, in the second exemplary embodiment, a relationship between the discharge product predictive quantity H and the charging voltage correction value such as that shown in Table 5 is used, the charging voltage correction value can be changed depending on environments. For example, in an environment in which the absolute humidity (absolute amount of moisture) is low, such as a low-temperature low-humidity environment, the correction value can be made smaller, and, in an environment in which the absolute humidity (absolute amount of moisture) is high, such as a high-temperature high-humidity environment, the correction value can be made larger. This is because the injection charging amount caused by discharge products differs depending on environments in which the image forming apparatus 100 is situated.

Moreover, while, in the second exemplary embodiment, a threshold value is set for the discharge product predictive quantity H and the charging voltage is corrected in a case where the discharge product predictive quantity H has exceeded the threshold value, the discharge product predictive quantity H and the correction value can be sequentially changed while being associated with each other. In other words, as the discharge product predictive quantity H is larger, the charging voltage correction value can be made larger.

Figure 11:
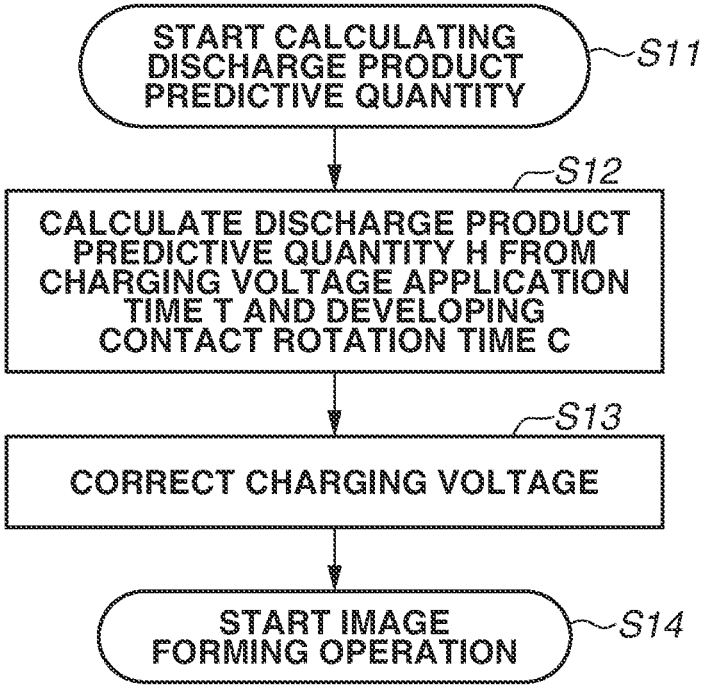
FIG. 11 is an operation flowchart for the image forming apparatus according to a second exemplary embodiment.

FIG. 11 is an example of a flowchart of control which predicts the amount of generation of discharge products at the time of non-image formation and then corrects the charging voltage. Specifically, acquisition of the discharge product predictive quantity H is performed, for example, when the image forming apparatus 100 has been powered on, when a change in environment has been detected by an environment sensor (not illustrated), or when a halt time elapsing from the last image formation is long. Alternatively, the control described in the second exemplary embodiment can be sequentially performed during a post-rotation which is performed while image formation is completed and the formed image passes through the fixing unit 6 and is then discharged to outside the image forming apparatus 100.

First, in step S11, the main body power source of the image forming apparatus 100 is turned on. After that, in step S12, the CPU 155 reads out the charging voltage application time T and the developing contact rotation time C previously stored in total in the control unit 202 or storage units (not illustrated) provided in the process cartridges 40Y, 40M, 40C, and 40K, and then calculates the discharge product predictive quantity H with use of formula (1). In step S13, the CPU 155 corrects the charging voltage to be used for image formation based on a result of calculation performed in step S12, thus determining the correction value for the charging voltage according to the relationship shown in Table 5, and, then in step S14, the CPU 155 starts an image forming operation.

<2. Advantageous Effect of Charging Voltage Control Using Discharge Product Prediction>

Next, checking of an advantageous effect obtained by predicting the quantity of discharge products during image formation was performed. Conditions for checking of the advantageous effect are the same as those described in the first exemplary embodiment. As a result of image formation having been performed with use of control in the second exemplary embodiment, fogging rose to the level in which fogging was not visible from first to last. This is considered to be because, since charging voltage control that was based on the discharge product predictive quantity was performed according to image formation and the value of the charging voltage was changed at appropriate timing, the influence of discharge products was able to be cancelled.

In the second exemplary embodiment, the image forming apparatus 100 includes an acquisition unit configured to acquire the quantity of discharge products adhering to the photosensitive drum 1, and the quantity of discharge products is acquired by the acquisition unit as a correlation value from the number of rotations of the developing roller 42 which is in the contact state at the developing portion and the time of application of the charging voltage. The charging voltage is corrected based on the correlation value correlating with the acquired quantity of discharge products. Specifically, in a case where the correlation value acquired by the acquisition unit is a second correlation value larger than a first correlation value, the control unit 202 performs image formation by applying a charging voltage the absolute value of which is larger than that in a case where the acquired correlation value is the first correlation value. Accordingly, instead of arranging the current measurement circuit 24 as in the first exemplary embodiment, predicting the quantity of discharge products enables maintaining the back contrast during image formation.

Performing such control enables keeping the optimum back contrast even if the dark portion potential Vd decreases at the time of passing through the developing portion, so that it is possible to print a good-quality image without fogging occurring therein.

While, in the second exemplary embodiment, the time of application of the charging voltage and the time for which the developing roller 42 is rotating while being in contact with the photosensitive drum 1 are used to predict the quantity of discharge products, for example, the time for which the photosensitive drum 1 is rotating while being in contact with the intermediate transfer belt 53 or the operating time of a discharge product removal unit can be used to perform such a prediction.

Moreover, while, in the second exemplary embodiment, formula (1) is used for calculation to predict the quantity of discharge products, a correlation value obtained by referring to a table previously prepared can also be used.

Moreover, while, in the second exemplary embodiment, the charging voltage is corrected to keep the back contrast optimum, the developing voltage can be corrected or the dark portion potential Vd obtained after charging by performing weak exposure, which is smaller in the amount of exposure than that for image formation, with use of the exposure unit 3 as in the modification example can be adjusted. Accordingly, in a case where the correlation value acquired by the acquisition unit is a second correlation value larger than a first correlation value, the control unit 202 can control the exposure unit 3 in such a way as to perform image formation with a first amount of exposure that is smaller than that in a case where the acquired correlation value is the first correlation value.

Moreover, in the case of performing a cleaning operation to remove discharge products adhering onto the surface of the photosensitive drum 1, an operation which, after the cleaning operation, resets the counted value for the discharge product predictive quantity H and then restarts counting can be performed. Alternatively, the counted value for the discharge product predictive quantity H can be corrected based on the time for which the cleaning operation is performed or the intensity at which the cleaning operation is performed.

A third exemplary embodiment of the present disclosure is directed to a method of, when performing image formation while switching between a plurality of image forming modes, keeping the back contrast appropriate according to the quantity of discharge products accumulated on the photosensitive drum 1 and a circumferential speed difference between the photosensitive drum 1 and the developing roller 42.

<1. Wide Color Gamut Image Forming Mode>

First, a plurality of image forming modes included in the image forming apparatus 100 according to the third exemplary embodiment is described.

The image forming apparatus 100 according to the third exemplary embodiment is able to perform a normal image forming mode, which performs image formation at a normal density, and a wide color gamut image forming mode, which widens the color gamut of an image, thus being able to form a better quality image. In the wide color gamut image forming mode, the circumferential speed ratio of the movement speed of the surface of the developing roller 42 to the movement speed of the surface of the photosensitive drum 1 is changed so as to be larger than that in the normal image forming mode. This increases the area of the surface of the developing roller 42 passing through per unit area of the surface of the photosensitive drum 1, so that it is possible to increase the amount of toner which is supplied from the developing roller 42 to the photosensitive drum 1 as compared with that in the normal image forming mode. Additionally, in the wide color gamut image forming mode, the developing contrast, which is a potential difference between the developing voltage Vdc, which is applied to the developing roller 42, and the light portion potential V1, which is the electric potential of a portion exposed by the exposure unit 3 in the surface of the photosensitive drum 1, is made larger. This enables increasing the amount of adhesion of toner in a toner image on the surface of the photosensitive drum 1 as compared with that in the normal image forming mode. Accordingly, it is possible to make the image density in the wide color gamut image forming mode higher than the image density in the normal image forming mode, and it is possible to widen the color gamut of an image to form a better quality image.

In the third exemplary embodiment, the circumferential speed ratio of the movement speed V2 of the surface of the developing roller 42 to the movement speed V1 of the surface of the photosensitive drum 1 was set to 140% in the case of the normal image forming mode and was set to 200% in the case of the wide color gamut image forming mode. Specifically, the movement speed of the surface of the developing roller 42 is set the same between the normal image forming mode and the wide color gamut image forming mode, and the movement speed of the surface of the photosensitive drum 1 in the wide color gamut image forming mode is set lower than the movement speed of the surface of the photosensitive drum 1 in the normal image forming mode. However, the movement speed of the surface of the photosensitive drum 1 can be set the same between the normal image forming mode and the wide color gamut image forming mode, and the movement speed of the surface of the developing roller 42 in the wide color gamut image forming mode is set higher than the movement speed of the surface of the developing roller 42 in the normal image forming mode.

Moreover, in the third exemplary embodiment, in the normal image forming mode, the dark portion potential Vd, which is the charging potential for the photosensitive drum 1 is set to −550 V, the developing voltage Vdc, which is applied to the developing roller 42, is set to −350 V, and the light portion potential V1 is set to −100 V. On the other hand, in the wide color gamut image forming mode, while the dark portion potential Vd and the developing voltage Vdc, which is applied to the developing roller 42, are set the same as those in the normal image forming mode, the light portion potential V1 is set to −50 V.

<2. Circumferential Speed Difference between Photosensitive Drum and Developing Roller and Injection Charging>

When there is a circumferential speed difference between the photosensitive drum 1 and the developing roller 42, if the circumferential speed difference is large, electric charges which have been formed on the surface of the photosensitive drum 1 at the developing portion may move to the developing roller 42. The dark portion potential Vd, which is the surface potential of the photosensitive drum 1 at a non-image forming portion in the configuration of the third exemplary embodiment, is set larger in absolute value than the developing voltage Vdc, and, since the developing roller 42 is kept in contact with the surface of the photosensitive drum 1 while being rotated, the dark portion potential Vd decreases. This is because, when the surface of the photosensitive drum 1 and the surface of the developing roller 42 frictionally slide on each other, electric charges which have been formed on the photosensitive drum 1 by charging move to the developing roller 42, to which electric charges are likely to move. As the potential difference between the dark portion potential Vd and the developing voltage Vdc is larger, since more electric charges flow from the surface of the photosensitive drum 1 to the developing roller 42, the movement of electric charges becomes more active. Moreover, as the circumferential speed difference between the developing roller 42 and the photosensitive drum 1 is larger, since the movement of electric charges similarly becomes more frequent, the decrease in the dark portion potential Vd becomes larger.

Figure 12:
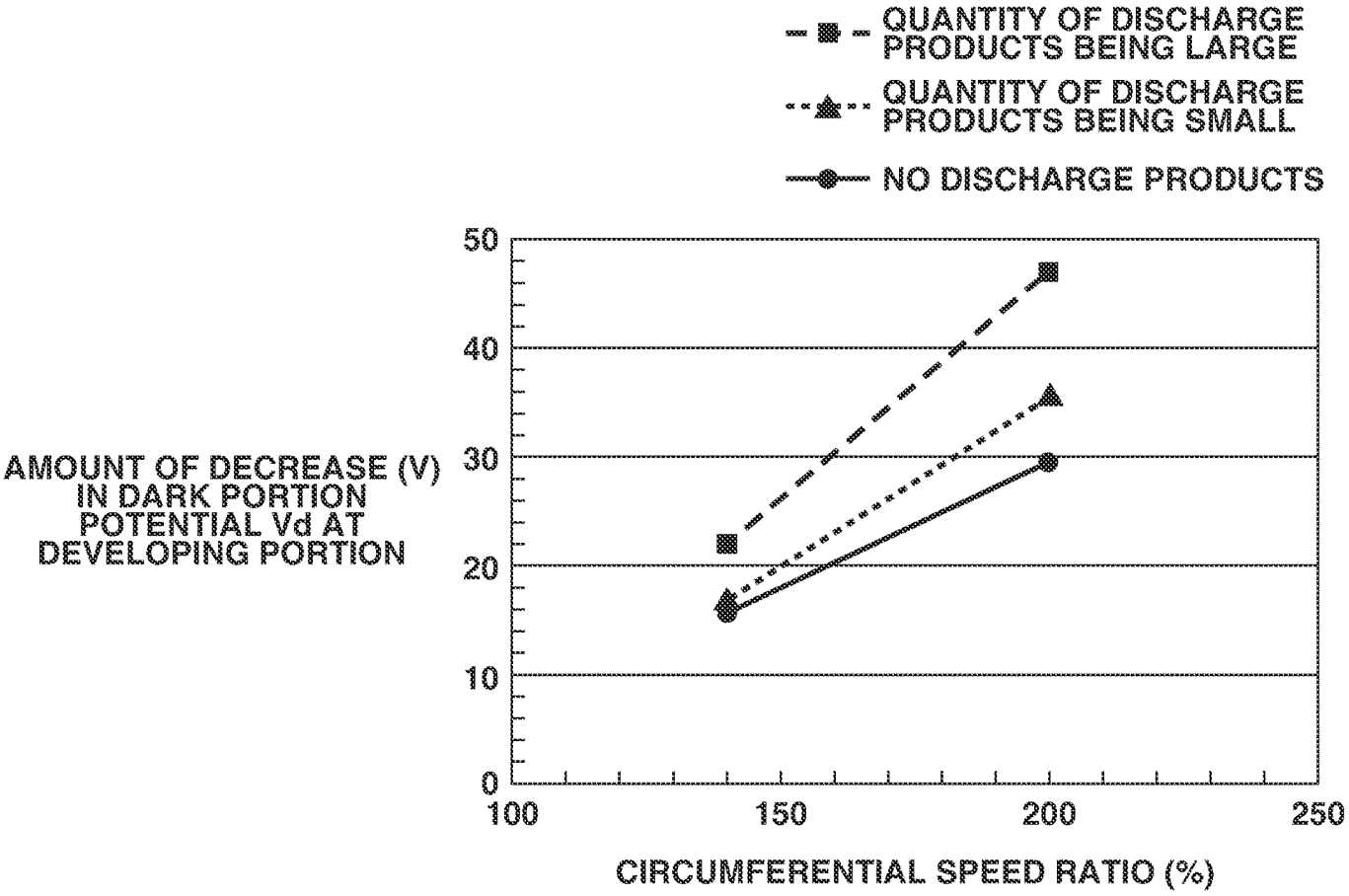
FIG. 12 is an explanatory diagram illustrating a relationship between a circumferential speed ratio and a dark portion potential (Vd) decrease amount in a third exemplary embodiment.

Next, the effect in which the surface potential of the photosensitive drum 1 decreases due to the developing roller 42 being in contact with the photosensitive drum 1 is described. FIG. 12 illustrates the amount of decrease in the surface potential of the photosensitive drum 1 with respect to the circumferential speed ratio of the movement speed of the surface of the developing roller 42 to the movement speed of the surface of the photosensitive drum 1. FIG. 12 is a graph chart illustrating an example of the amount of decrease in the dark portion potential Vd at the developing portion, which was measured under an environment of 25° C. in temperature and 50% in relative humidity while the circumferential speed ratio of the movement speed of the surface of the developing roller 42 to the movement speed of the surface of the photosensitive drum 1 was varied. The surface potentials of the photosensitive drum 1 obtained before and after passing through the developing portion were measured by a surface potential meter (Model 344) manufactured by TREK, INC., and the difference thereof was set as the amount of decrease in surface potential. With regard to the photosensitive drum 1, a new photosensitive drum and photosensitive drums which were respectively used for image printing on 1,000 sheets and 10,000 sheets of recording material P in one-sheet intermittent printing mode by the image forming apparatus 100 illustrated in FIG. 1 were used. The reason why photosensitive drums 1 previously subjected to sheet passing are used is that this phenomenon is conspicuous in the state in which discharge products have adhered onto the photosensitive drum 1. The photosensitive drum 1 subjected to sheet passing of 1,000 sheets and the photosensitive drum 1 subjected to sheet passing of 10,000 sheets were used for comparison as a condition in which the quantity of discharge products is small and a condition in which the quantity of discharge products is large, respectively. The horizontal axis in FIG. 12 indicates the circumferential speed ratio of the developing roller 42 to the photosensitive drum 1. The vertical axis in FIG. 12 indicates the amount of decrease in the surface potential of the photosensitive drum 1 at the developing portion.

As can be seen from FIG. 12, when the circumferential speed ratio of the developing roller 42 to the photosensitive drum 1 is large, the amount of decrease in the surface potential of the photosensitive drum 1 becomes large. The decrease in the surface potential of the photosensitive drum 1 occurs due to the movement of electric charges to the developing roller 42. Accordingly, when the circumferential speed ratio is large, since the substantial contact area between the surface of the photosensitive drum 1 and the surface of the developing roller 42 becomes large, the opportunity for electric charges to move from the surface of the photosensitive drum 1 to the developing roller 42 increases. Moreover, even if the quantity of discharge products on the surface of the photosensitive drum 1 is the same, when the circumferential speed ratio of the developing roller 42 to the photosensitive drum 1 is large, the amount of decrease in the dark portion potential Vd of the surface of the photosensitive drum 1 at the developing portion becomes large. Specifically, the amount of decrease in the dark portion potential Vd is larger in the wide color gamut image forming mode, in which the circumferential speed ratio is 200%, than in the normal image forming mode, in which the circumferential speed ratio is 140%. Moreover, when the quantity of discharge products becomes large, the influence of the circumferential speed ratio of the developing roller 42 to the photosensitive drum 1 becomes larger. This phenomenon is considered as follows.

At the developing portion, the surface of the photosensitive drum 1 and the surface of the developing roller 42 are in contact with each other across toner 90. Therefore, not only the decrease of electric charge retention capability due to discharge products on the surface of the photosensitive drum 1 but also the resistance component of toner 90 greatly affects the flow of electric charges. Here, in a case where the photosensitive drum 1 and the developing roller 42 have a circumferential speed difference (in a case where the circumferential speed ratio is not 100%), toner 90 moves while rolling at the developing portion due to the frictional sliding between the surface of the photosensitive drum 1 and the surface of the developing roller 42. Then, along with such rolling movement of toner 90, electric charges retained on the surface of toner 90 move between the surface of the photosensitive drum 1 and the surface of the developing roller 42, so that the resistance component of toner 90 becomes apparently small. More specifically, as the circumferential speed ratio of the developing roller 42 to the photosensitive drum 1 becomes larger, the resistance component of toner 90 becomes apparently smaller, so that electric charges on the surface of the photosensitive drum 1 becomes likely to flow to the developing roller 42. Accordingly, it is considered that, when the circumferential speed ratio of the developing roller 42 to the photosensitive drum 1 becomes large, the amount of decrease in the dark portion potential Vd becomes large.

Figure 13:
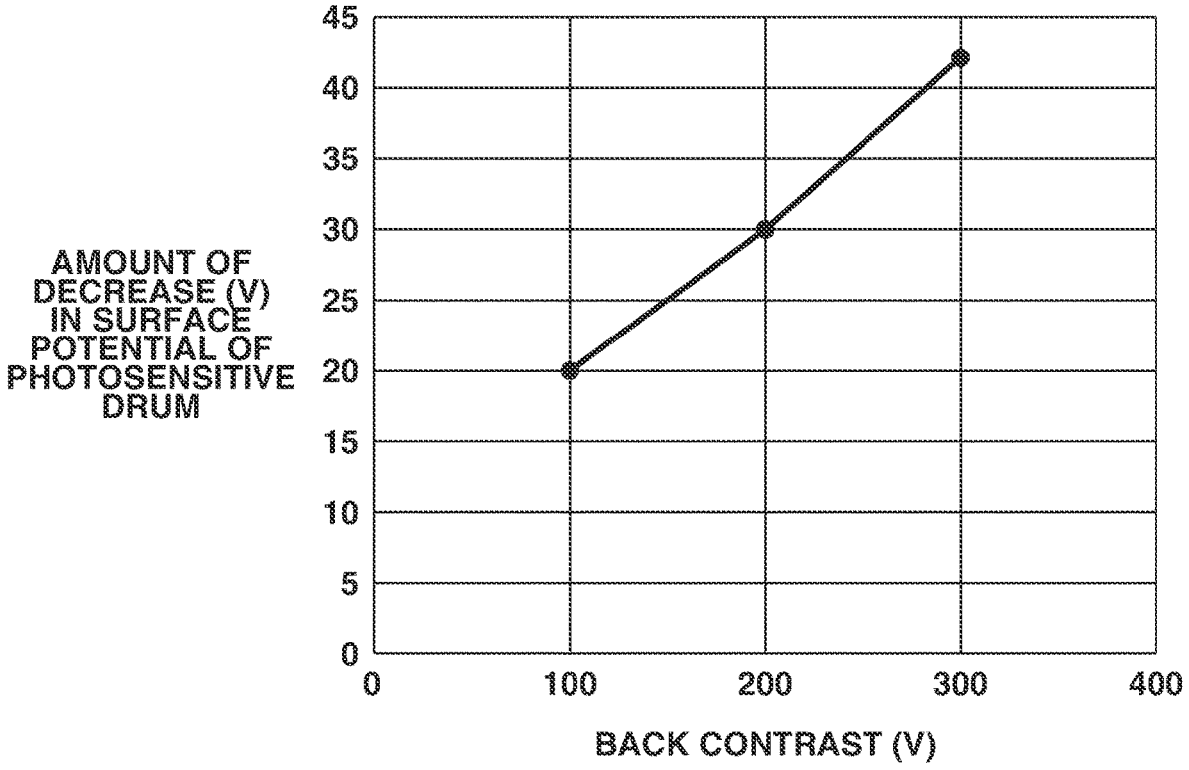
FIG. 13 is an explanatory diagram illustrating a relationship between back contrast and a photosensitive drum surface potential decrease amount in the third exemplary embodiment.

FIG. 13 illustrates the amount of decrease in the surface potential of the photosensitive drum 1 with respect to the back contrast. The horizontal axis in FIG. 13 indicates the value of the back contrast. The vertical axis in FIG. 13 indicates the amount of decrease in the surface potential of the photosensitive drum 1, as with FIG. 12. A condition in which a new photosensitive drum 1 (without discharge products adhering thereto) was used and the circumferential speed ratio of the developing roller 42 to the photosensitive drum 1 was 200% (the wide color gamut image forming mode) was used. As illustrated in FIG. 13, as the back contrast was larger, the amount of decrease in the surface potential of the photosensitive drum 1 became larger. This is because, when the back contrast is made large, since the potential difference between the developing voltage applied to the developing roller 42 and the surface potential of the photosensitive drum 1 becomes large, electric charges on the photosensitive drum 1 become more likely to flow to the developing roller 42. In a case where the back contrast is 200

V, under a condition in which the circumferential speed ratio of the developing roller 42 to the photosensitive drum 1 is 200%, a change in electric potential of 30 V would occur due to injection charging.

The above-mentioned results suggest that examples of factors which vary the surface potential of the photosensitive drum 1 include the surface resistance of the photosensitive drum 1, i.e., the quantity of discharge products on the photosensitive drum 1, and the circumferential speed ratio of a member which is in contact with the photosensitive drum 1 to the photosensitive drum 1.

<3. Charging Voltage Control by Circumferential Speed Ratio of Developing Roller to Photosensitive Drum>

Next, charging voltage correction control in the third exemplary embodiment is described.

Figure 14:
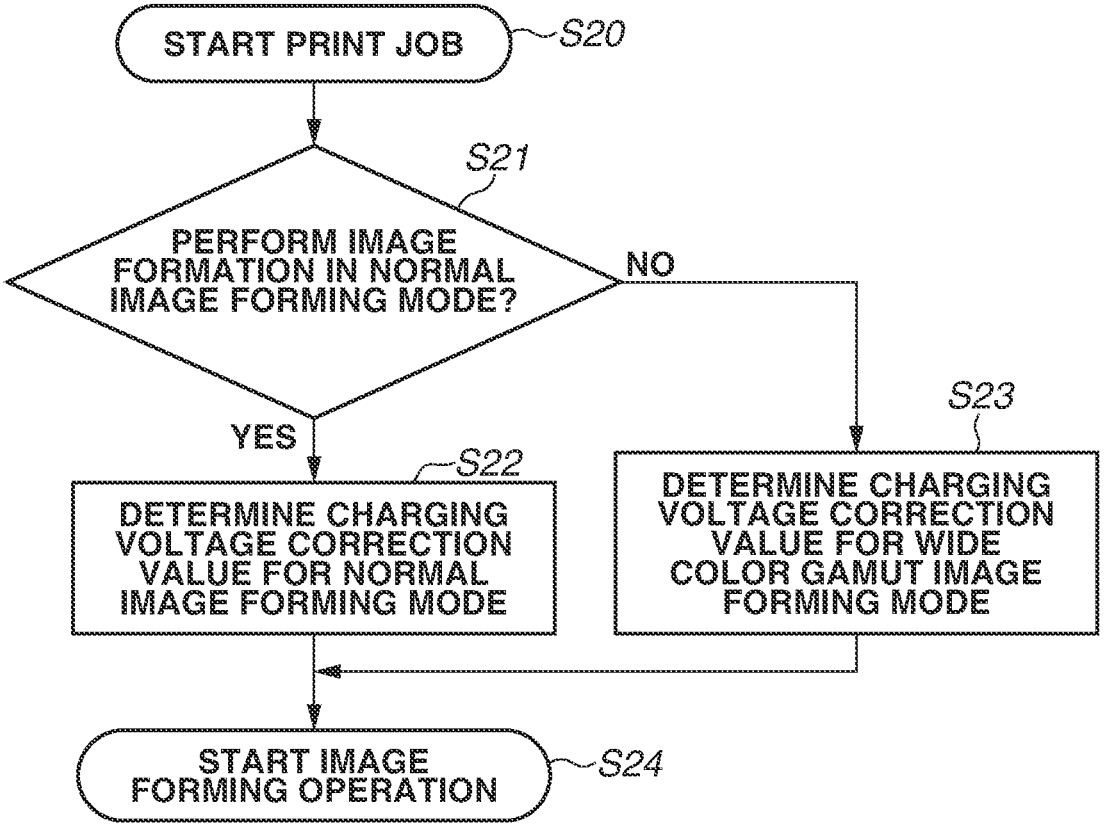
FIG. 14 is an operation flowchart for the image forming apparatus according to the third exemplary embodiment.

FIG. 14 is a flowchart illustrating charging voltage correction control in the third exemplary embodiment.

First, when, in step S20, a print job is started, then in step S21, the control unit 202 determines in which of the normal image forming mode and the wide color gamut image forming mode to perform image formation. Here, if the normal image forming mode is selected by the user (YES in step S21), the control unit 202 advances the processing to step S22. Then, in step S22, the control unit 202 determines a charging voltage correction value based on a result of detection of the injection charging current and the circumferential speed ratio of the developing roller 42 to the photosensitive drum 1 in the normal image forming mode. The detection of the injection charging current at this time can be performed by actual measurement as in the first exemplary embodiment, or can be performed by predictive control as in the second exemplary embodiment. In the third exemplary embodiment, the detection of the injection charging current is performed by the predetermined method described in the first exemplary embodiment regardless of the image forming mode. After that, in step S24, the control unit 202 starts a predetermined image forming operation, thus performing image formation. On the other hand, if the wide color gamut image forming mode is selected by the user (NO in step S21), the control unit 202 advances the processing to step S23. Then, in step S23, the control unit 202 determines a charging voltage correction value based on a result of detection of the injection charging current and the circumferential speed ratio of the developing roller 42 to the photosensitive drum 1 in the wide color gamut image forming mode, and then in step S24, the control unit 202 starts a predetermined image forming operation. Moreover, in the third exemplary embodiment, the charging voltage correction value is determined based on Table 6 shown below. For example, the charging voltage correction value in a case where the measured integrated current value is 1.0 μA·sec is −16 V in the case of the normal image forming mode, but is −44 V in the case of the wide color gamut image forming mode. In other words, since the charging voltage value in the third exemplary embodiment is −1,100 V, the charging voltage value as corrected and the dark portion potential Vd are −1,116 V and −566 V, respectively, in the normal image forming mode and are −1,144 V and −594 V, respectively, in the wide color gamut image forming mode.

TABLE 6

| Integrated current value (μA · sec) | | Less than 0.4 | Greater than or equal to 0.4 and less than 0.8 | Greater than or equal to 0.8 and less than 1.1 | Greater than or equal to 1.1 and less than 1.5 |
|---|---|---|---|---|---|
| Charging voltage correction value (-V) | Normal image forming mode 140% | 0 | 8 | 16 | 24 |
| | Wide color gamut image forming mode 200% | 20 | 32 | 44 | 56 |

| Integrated current value (μA · sec) | | Greater than or equal to 1.5 and less than 1.9 | Greater than or equal to 1.9 and less than 2.3 | Greater than or equal to 2.3 |
|---|---|---|---|---|
| Charging voltage correction value (-V) | Normal image forming mode 140% | 32 | 40 | 50 |
| | Wide color gamut image forming mode 200% | 68 | 80 | 100 |

<4. Advantageous Effect of Charging Voltage Control by Switching of Image Forming Modes>

Checking of an advantageous effect obtained by performing charging voltage control was performed under a condition in which the image forming modes were switched. Conditions for checking of the advantageous effect are the same as those described in the first exemplary embodiment and the second exemplary embodiment. The difference is that checking of the level of fogging is performed in both the case of the normal image forming mode and the case of the wide color gamut image forming mode. A comparative example 1 corresponds to a case where, in both the normal image forming mode and the wide color gamut image forming mode, image formation is performed without charging voltage control being performed. A comparative example 2 corresponds to a case where, in the normal image forming mode, image formation is performed with charging voltage control being performed and, in the wide color gamut image forming mode, image formation is performed under the condition used for the normal image forming mode. The third exemplary embodiment corresponds to a case where, in both the normal image forming mode and the wide color gamut image forming mode, image formation is performed with charging voltage control being performed. The results are shown in Table 7.

TABLE 7

| Number of image-formed sheets (sheets) | | 1000 | 3000 | 5000 |
|---|---|---|---|---|
| Comparative example 1 | Normal image forming mode 140% | Y | N | N |
| | Wide color gamut image forming mode 200% | N | N | N |
| Comparative example 2 | Normal image forming mode 140% | Y | Y | Y |
| | Wide color gamut image forming mode 200% | N | N | N |
| Third exemplary embodiment | Normal image forming mode 140% | Y | Y | Y |
| | Wide color gamut image forming mode 200% | Y | Y | Y |

As can be seen from the results shown in Table 7, in the conditions of the comparative example 1 and the comparative example 2, since charging voltage control was not performed in the wide color gamut image forming mode, the decrease in back contrast at the developing portion was caused in the wide color gamut image forming mode, so that fogging occurred. On the other hand, in the third exemplary embodiment, in which charging voltage control was performed in both the normal image forming mode and the wide color gamut image forming mode, fogging rose to the level in which fogging was not visible from first to last in any of the modes. This is considered to be because, since charging voltage control was performed according to the image forming condition and the value of the charging voltage was changed at appropriate timing, the influence of discharge products was able to be cancelled.

In the third exemplary embodiment, in the case of performing image formation while switching between a plurality of image forming modes which differs in the circumferential speed ratio of the developing roller 42 to the photosensitive drum 1, the control unit 202 corrects the charging voltage based on information about injection charging and the circumferential speed ratio, thus correcting the back contrast. With this, even in the case of performing image formation while switching between a plurality of image forming modes, it is possible to continuously print fogging-free and good-quality images without having to perform a cleaning operation.

While, in the third exemplary embodiment, the charging voltage is corrected to keep the back contrast optimum, the present exemplary embodiment is not limited to this. For example, the developing voltage can be corrected, or the dark portion potential Vd obtained after charging can be adjusted by weak exposure with the exposure unit 3 used as in the modification example. Accordingly, when performing a second image forming mode during image formation, the control unit 202 can perform control to make a first amount of exposure smaller than that when performing a first image forming mode.

Moreover, while, in the third exemplary embodiment, correction control is performed by indirectly measuring the quantity of discharge products with detection of injection charging currents, the present exemplary embodiment is not limited to this. For example, as described in the second exemplary embodiment, correction control can be performed by predicting the quantity of discharge products with use of the time of application of the charging voltage and the time for which the developing roller 42 is driven while being in contact with the photosensitive drum 1. Additionally, in this case, for example, the time for which the photosensitive drum 1 rotates while being in contact with the intermediate transfer belt 53 or the operating time of a discharge product removal unit can be used for prediction.

<1. Change in Surface Potential of Photosensitive Drum due to Developing Contact and Separation>

A fourth exemplary embodiment of the present disclosure is directed to a method of directly measuring the amount of decrease in the surface potential of the photosensitive drum 1 by measuring the surface potential of the photosensitive drum 1 obtained when the developing roller 42 and the photosensitive drum 1 are separate from each other and the surface potential of the photosensitive drum 1 obtained when the developing roller 42 and the photosensitive drum 1 are in contact with each other, thus keeping the back contrast optimum. To cause the developing roller 42 to separate from and come into contact with the photosensitive drum 1, the fourth exemplary embodiment includes a developing separation mechanism (not illustrated).

Figure 15:
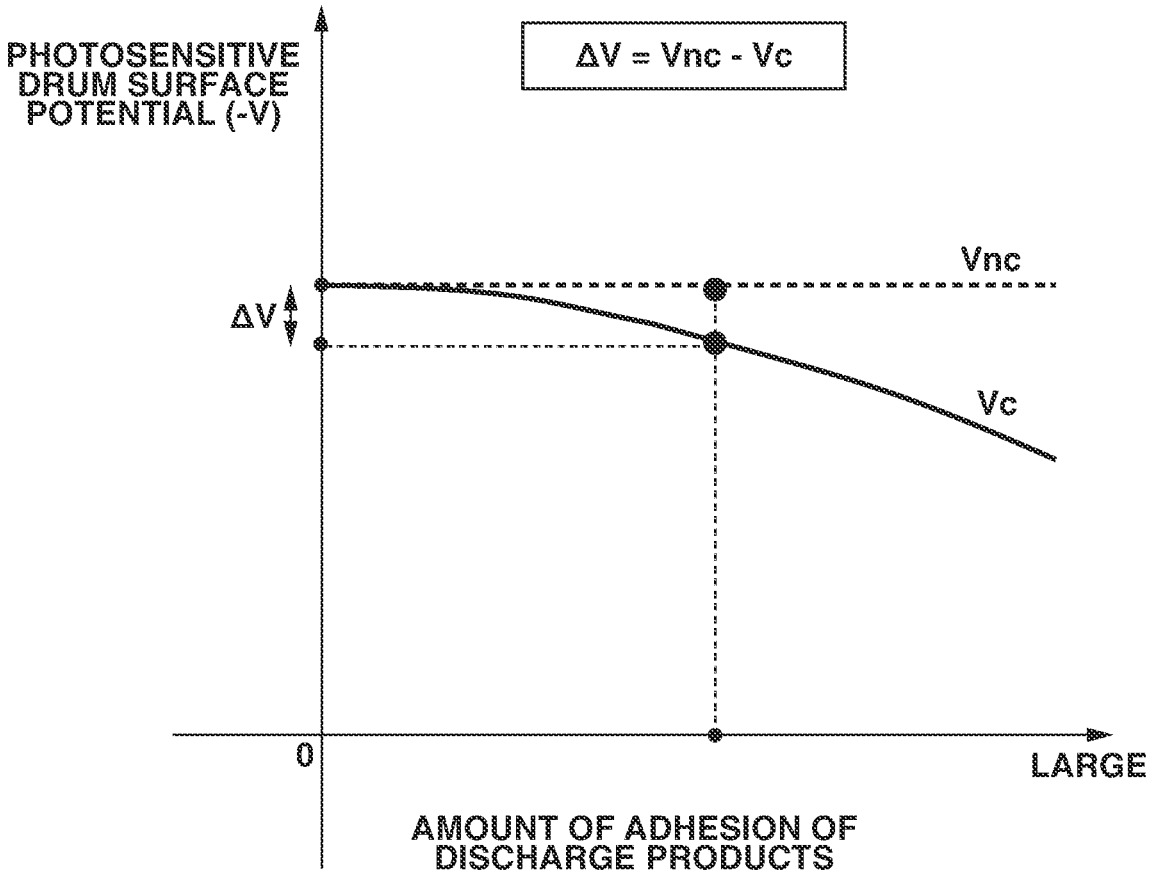
FIG. 15 is an explanatory diagram illustrating a relationship between the quantity of discharge products and a surface potential in a fourth exemplary embodiment.

FIG. 15 illustrates the surface potential (Vnc) of the photosensitive drum 1 obtained during developing separation and the surface potential (Vc) of the photosensitive drum 1 obtained during developing contact each of which correspond to the amount of adhesion of discharge products adhering to the surface of the photosensitive drum 1. The surface potentials of the photosensitive drum 1 obtained after passing through the developing portion during contact and during separation of the developing roller 42 with respect to the surface of the photosensitive drum 1 were measured by a surface potential meter (Model 344) manufactured by TREK, INC. The transition of the surface potential of the photosensitive drum 1 obtained during developing separation stays unchanged regardless of the amount of adhesion of discharge products to the photosensitive drum 1. On the other hand, as the amount of adhesion of discharge products increases, the absolute value of the surface potential (Vc) of the photosensitive drum 1 obtained during developing contact decreases. Therefore, as the amount of accumulation of discharge products increases, fogging gradually becomes worse, so that, eventually, fogging may exceed the level of being visible. Accordingly, the fourth exemplary embodiment provides a method of preventing or reducing fogging by directly measuring the surface potential (Vnc) obtained during developing separation and the surface potential (Vc) obtained during developing contact to calculate the potential attenuation amount $\Delta V$ and adding the calculated potential attenuation amount $\Delta V$ to the charging voltage to be applied to the charging roller 2.

<2. Method of Detecting Surface Potential of Photosensitive Drum>

The method of detecting the surface potential of the photosensitive drum 1, which is a characteristic of the fourth exemplary embodiment, is described. Measurement of the surface potential of the photosensitive drum 1 can be performed during a pre-rotation process, which is performed before an image forming operation is performed, or during a post-rotation process, or only such a measurement operation can be performed in a single manner. The surface potential detection method for the photosensitive drum 1 detects the dark portion potential Vd, which is the surface potential of the photosensitive drum 1 obtained during image formation. In the fourth exemplary embodiment, the primary transfer roller 51 is used as a surface potential detection unit for the photosensitive drum 1. Using the primary transfer roller 51 as a surface potential detection unit for the photosensitive drum 1 enables detecting the surface potential of the photosensitive drum 1 without any additional member. Furthermore, the charging roller 2 can be used as a surface potential detection unit for the photosensitive drum 1, or a different contact member can be used. The fourth exemplary embodiment detects the surface potential in a state in which the photosensitive drum 1 has become at the dark portion potential Vd in a uniform manner. Moreover, the surface potential of the photosensitive drum 1 can be directly measured by the above-mentioned surface potential meter. In that case, it is desirable to measure the surface potential of the photosensitive drum 1 at the downstream side of the developing portion in the rotational direction of the photosensitive drum 1.

Figure 16:
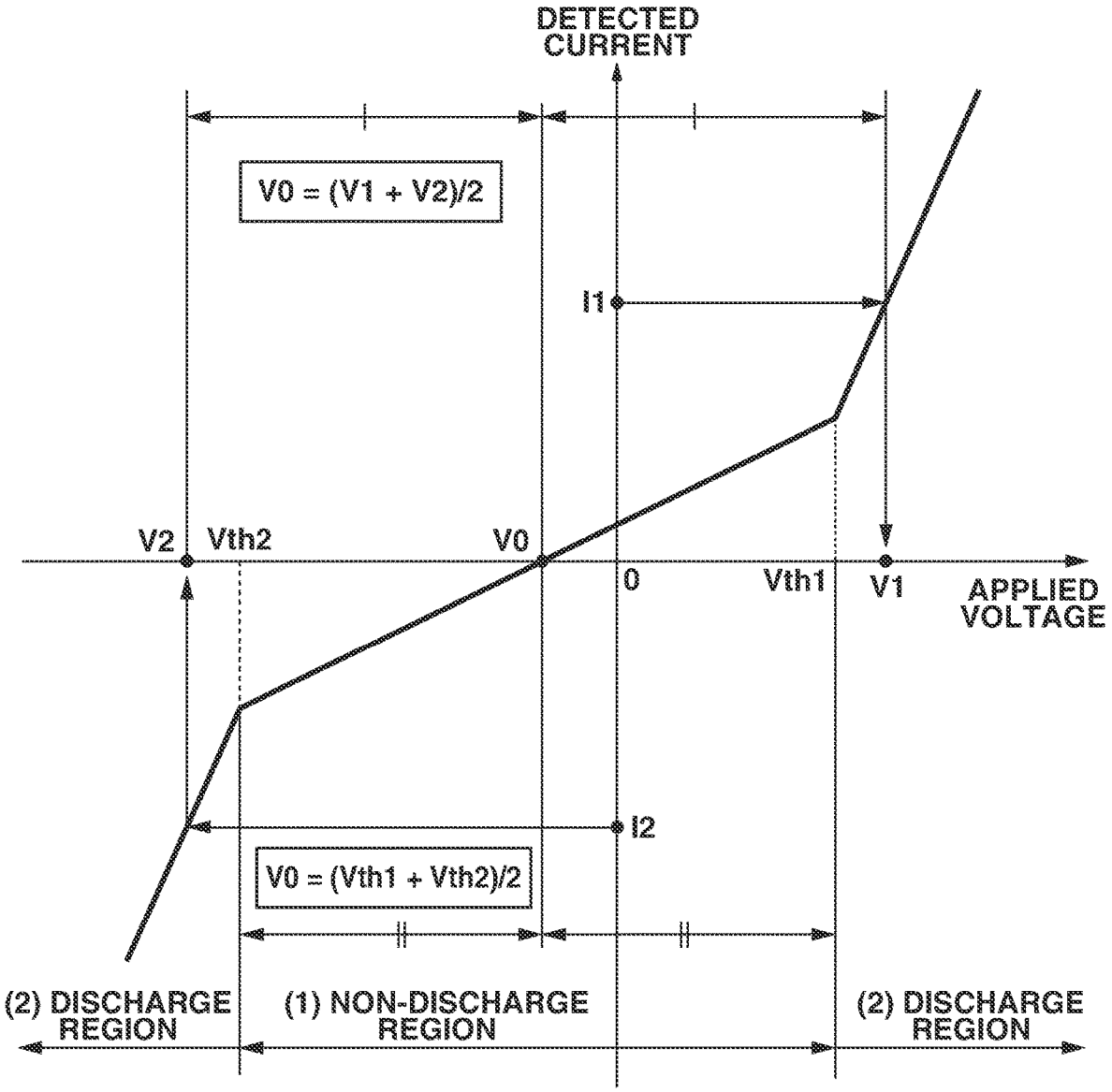
FIG. 16 is an explanatory diagram illustrating a relationship between a transfer voltage and a current flowing to the photosensitive drum in the fourth exemplary embodiment.

Here, a method of obtaining the surface potential of the photosensitive drum 1 in the fourth exemplary embodiment is described. FIG. 16 illustrates a relationship between the transfer voltage value which is applied to the primary transfer roller 51 and the current value which flows to the photosensitive drum 1. The region in which the absolute value of the transfer voltage value which is applied to the primary transfer roller 51 is smaller than the discharge start voltage Vth (a region (1) illustrated in FIG. 16) is a region in which the dark current and the injection current, which corresponds to the amount of adhesion of discharge products, flow between the primary transfer roller 51 and the photosensitive drum 1. Hereinafter, the region in which the dark current and the injection current, which corresponds to the amount of adhesion of discharge products, flow is referred to as a "non-discharge region". The region in which the absolute value of the transfer voltage value which is applied to the primary transfer roller 51 is larger than the discharge start voltage Vth (a region (2) illustrated in FIG. 16) is a region in which a discharge phenomenon occurs between the primary transfer roller 51 and the photosensitive drum 1 (hereinafter referred to as a "discharge region"). In FIG. 16, the transfer voltage value at which the current value flowing between the primary transfer roller 51 and the photosensitive drum 1 becomes zero is set as the reference surface potential V0 of the photosensitive drum 1. As illustrated in FIG. 16, the relationship between the applied transfer voltage and the detected current has a symmetry with respect to the reference surface potential V0. The method obtains, via previous studies, the influences of, for example, the film thickness, atmosphere temperature, and atmosphere humidity of the photosensitive drum 1 and the electrical resistance value of the primary transfer roller 51 on the discharge start voltage Vth, obtains the maximum discharge start voltage Vth, and applies a transfer voltage higher than or equal to the absolute value of the maximum discharge start voltage Vth. In other words, the method applies a transfer voltage which necessarily causes an electric discharge between the primary transfer roller 51 and the photosensitive drum 1. Moreover, the method can obtain, via previous studies, a current value which corresponds to a discharge region, and can determine that the applied voltage is within a discharge region if the detected current value is greater than or equal to the obtained current value. In a discharge region, the transfer voltage value which is applied and the detected current value have a linear relationship. Therefore, measuring three points, i.e., two measurement points the absolute value of each of which is greater than or equal to the discharge start voltage Vth and a measurement point the reverse-polarity absolute value of which is greater than or equal to the discharge start voltage Vth across the potential (V0) intended to be obtained enables obtaining a relationship between the transfer voltage value which is applied and the detected current value in a discharge region. In the fourth exemplary embodiment, to detect the surface potential of the photosensitive drum 1, it is not always necessary to obtain the discharge start voltage Vth.

Figure 17:
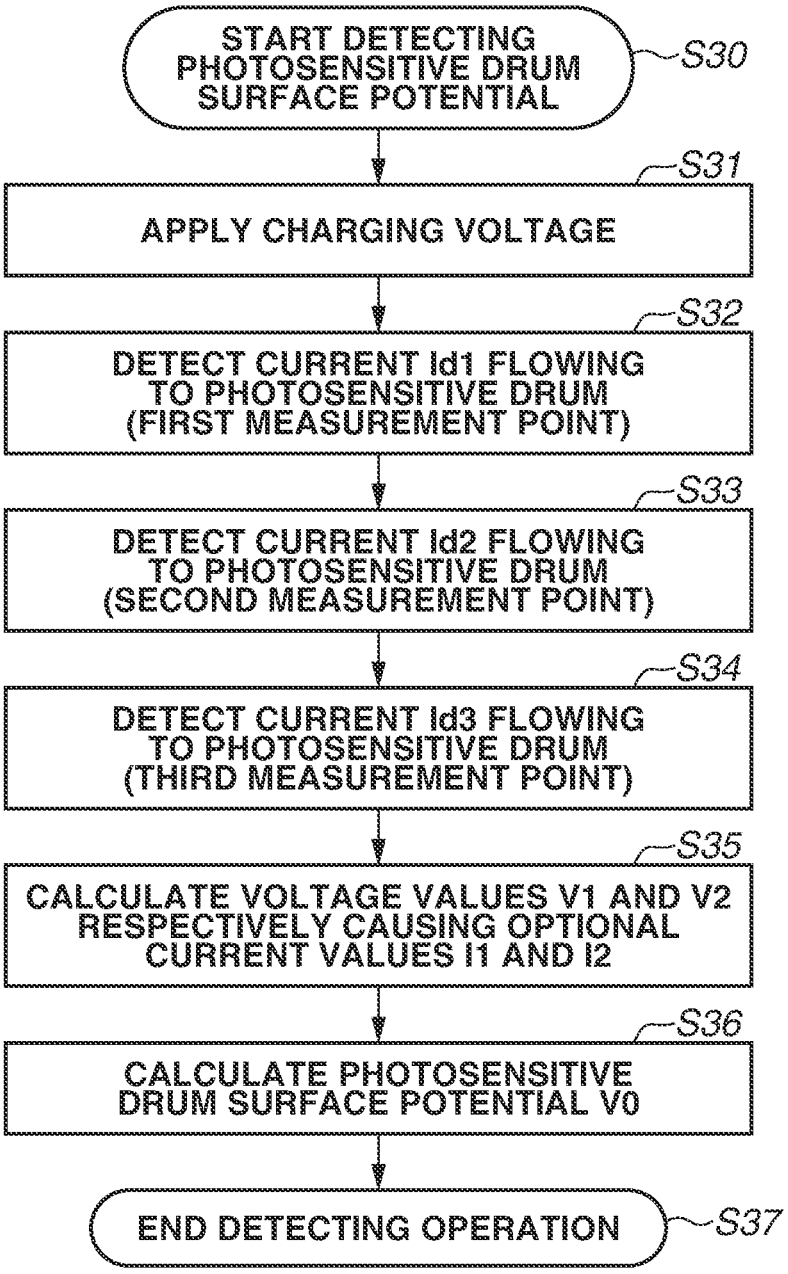
FIG. 17 is a control flowchart for surface potential measurement for the photosensitive drum in the fourth exemplary embodiment.
Figure 18:
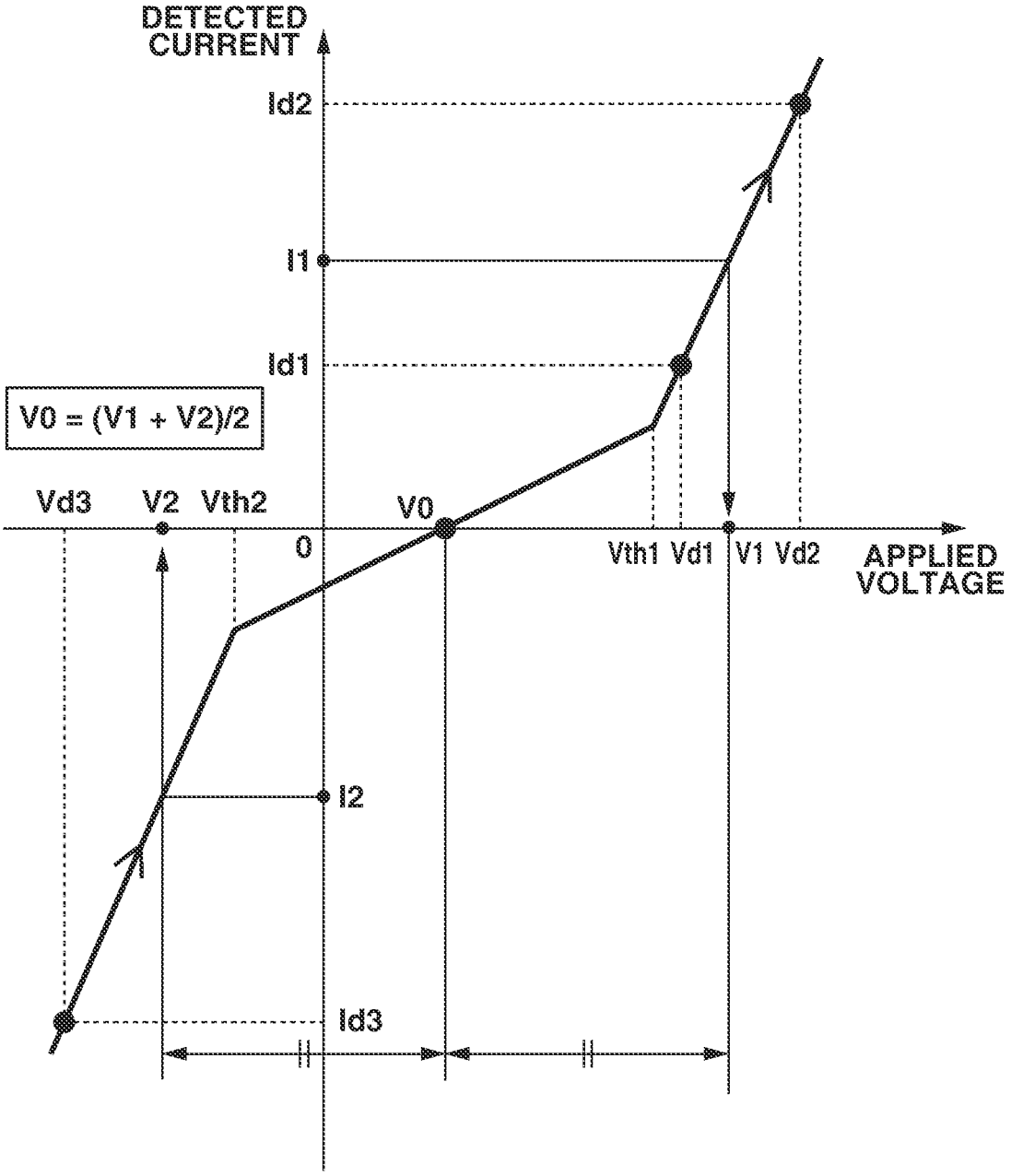
FIG. 18 is an explanatory diagram illustrating a relationship between a transfer voltage and a current flowing to the photosensitive drum in the fourth exemplary embodiment.

A specific surface potential detection method for the photosensitive drum 1 is described. FIG. 17 is a flowchart illustrating the surface potential detection method for the photosensitive drum 1. In step S30, the control unit 202 starts surface potential detection for the photosensitive drum 1, and in step S31, during rotational driving of the photosensitive drum 1, the control unit 202 applies the charging voltage to the charging roller 2 to uniformly charge the photosensitive drum 1. Next, the control unit 202 applies the transfer voltage to the primary transfer roller 51, and detects a current flowing to the photosensitive drum 1 by a current detection unit (not illustrated). FIG. 18 illustrates a relationship between the voltage value which is applied to the primary transfer roller 51 and the current which flows to the photosensitive drum 1 in the fourth exemplary embodiment. Referring to FIG. 18, in the fourth exemplary embodiment, first, the control unit 202 applies a voltage Vd1 the absolute value of which is greater than or equal to the discharge start voltage Vth1 to the primary transfer roller 51, and then in step S32, the control unit 202 detects a current Id1 flowing to the photosensitive drum 1 by the current detection unit. Next, the control unit 202 applies a voltage Vd2 the absolute value of which is greater than or equal to the discharge start voltage Vth1, the polarity of which is the same as that of the voltage Vd1, and the absolute value of which is greater than the voltage Vd1 to the primary transfer roller 51, and then in step S33, the control unit 202 detects a current Id2 flowing to the photosensitive drum 1 by the current detection unit. Next, the control unit 202 applies a voltage Vd3 the absolute value of which is greater than or equal to the discharge start voltage Vth2 to the primary transfer roller 51, and then in step S34, the control unit 202 detects a current Id3 flowing to the photosensitive drum 1 by the current detection unit. Here, the control unit 202 sets the applied voltage value Vd3 in such a manner that the current Id3 is opposite in direction of flowing current to the currents Id1 and Id2. Thus, the discharge start voltage Vth2 is a discharge start voltage Vth which starts an electric discharge of the polarity opposite to that of the discharge start voltage Vth1. From the results of the above three measurement points, the control unit 202 is able to obtain a relationship between the applied voltage value and the detected current value in discharge regions. In the fourth exemplary embodiment, in step S35, the control unit 202 obtains an applied voltage value V1 which causes an optional current value I1 in a discharge region and an applied voltage value V2 which causes an optional current value I2 the absolute value of which is the same as that of the current value I1 and which is opposite in direction of flowing current to the current value H. In step S36, from the relationship in which the applied voltage value V1 and the applied voltage value V2 are symmetric with respect to the potential V0 to be obtained, the control unit 202 obtains the surface potential V0 of the photosensitive drum 1 by "V0=(V1+V2)/2". Furthermore, while, in the fourth exemplary embodiment, a relationship between the applied voltage value and the detected current value in a discharge region is obtained from three measurement points, it is not always necessary to perform measurement with three points, but the relationship can be obtained from three or more measurement points. Moreover, a relationship between the applied voltage value and the detected current value in a discharge region can be obtained by scanning the applied voltage value and the detected current value. After calculating the surface potential of the photosensitive drum 1, then in step S37, the control unit 202 ends the detecting operation.

<3. Charging Voltage Control by Developing Contact and Separation>

Next, charging voltage correction control in the fourth exemplary embodiment is described.

In the charging voltage correction control, the surface potential (Vnc) of the photosensitive drum 1 obtained during developing separation and the surface potential (Vc) of the photosensitive drum 1 obtained during developing contact each of which corresponds to the amount of adhesion of discharge products adhering to the surface of the photosensitive drum 1 are measured by a surface potential measuring method, a difference value ΔV between the surface potentials Vnc and Vc is calculated, and the surface potential is corrected based on the difference value ΔV.

Figure 19:
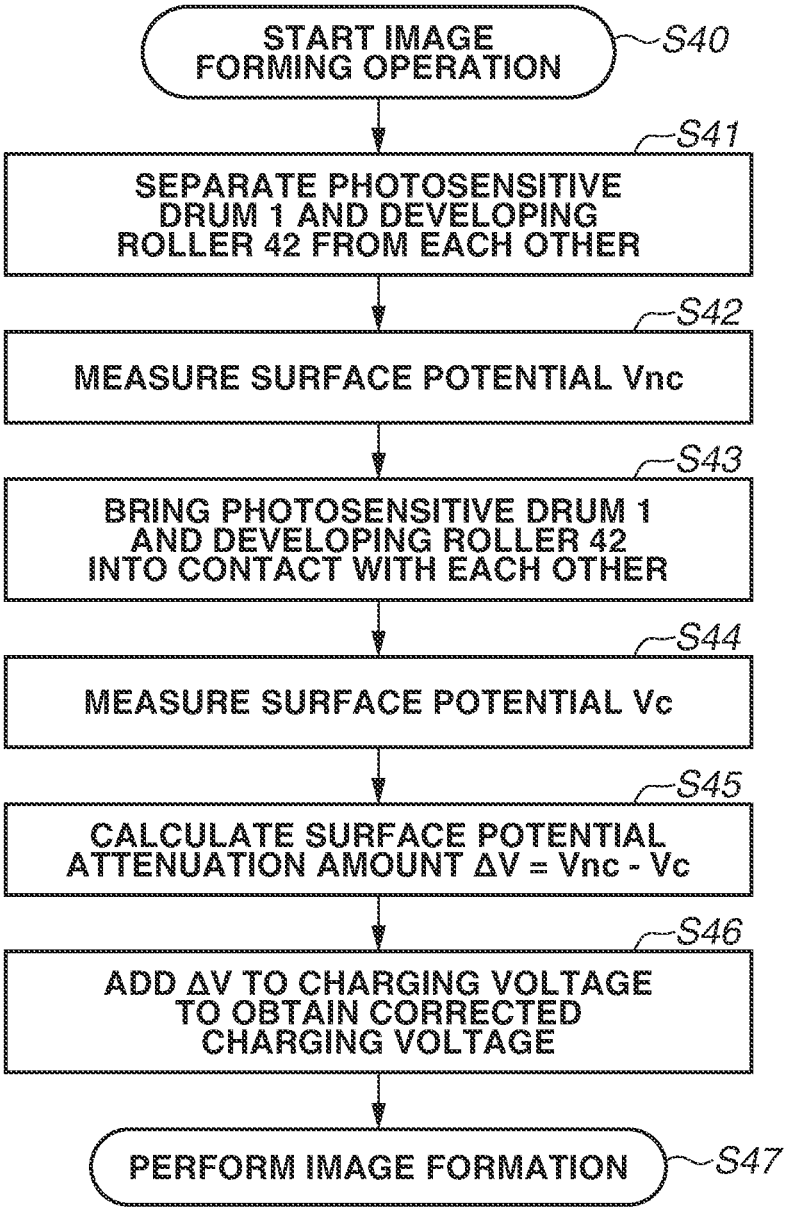
FIG. 19 is an operation flowchart for the image forming apparatus according to the fourth exemplary embodiment.

FIG. 19 is a flowchart illustrating a method of correcting the surface potential of the photosensitive drum 1 by correcting the charging voltage. When, in step S40, the control unit 202 starts an image forming operation, first, in step S41, the control unit 202 causes a developing contact and separation mechanism (not illustrated) to separate the photosensitive drum 1 and the developing roller 42 from each other in such a way as to be in a non-contact state. The control unit 202 drives the photosensitive drum 1 in a separated state and electrically charges the photosensitive drum 1 with the charging roller 2, and then in step S42, the control unit 202 measures the surface potential (Vnc) of the photosensitive drum 1 during developing separation by the above-mentioned surface potential detection method. Then, in step S43, the control unit 202 brings the photosensitive drum 1 and the developing roller 42 into contact with each other while driving the developing roller 42 at the surface movement speed which is the same as that during image formation. In that state, in step S44, the control unit 202 measures the surface potential (Vc) of the photosensitive drum 1 during developing contact by the surface potential detection unit. In step S45, the control unit 202 calculates the potential attenuation amount ΔV from the difference value between the surface potentials Vnc and Vc obtained in steps S42 and S44, and in step S46, the control unit 202 adds the calculated potential attenuation amount ΔV to the charging voltage (Vd+Vth), thus obtaining the corrected charging voltage. Then, in step S47, the control unit 202 performs image formation while applying the corrected charging voltage value during image formation.

<4. Advantageous Effect of Charging Voltage Control by Photosensitive Drum Surface Potential Measurement in Developing Contact and Separation>

Checking of an advantageous effect obtained by performing charging voltage control based on results obtained by performing photosensitive drum surface potential measurement in developing contact and separation and performing image formation was performed. Conditions for checking of the advantageous effect are the same as those described in the first to third exemplary embodiments. As a result of image formation being performed with use of the control described in the fourth exemplary embodiment, even after image formation was performed, fogging rose to the level in which fogging was not visible from first to last. This is considered to be because, since the surface potentials of the photosensitive drum 1 obtained when developing contact and separation was performed according to image formation were measured, charging voltage control was performed based on results of such measurement, and the value of the charging voltage was changed at appropriate timing, the influence of discharge products was able to be cancelled.

As described above, the fourth exemplary embodiment is provided with a contact and separation mechanism (not illustrated) which moves at the developing portion between a contact position in which the developing roller 42 is in contact with the photosensitive drum 1 and a separation position in which the developing roller 42 is separate from the photosensitive drum 1. First, the control unit 202 applies the charging voltage to the charging roller 2 while rotating the photosensitive drum 1, and measures the surface potential of the surface of the photosensitive drum 1 passing through the developing portion with the contact and separation mechanism moved to the contact position. Then, the control unit 202 measures the surface potential of the surface of the photosensitive drum 1 with the contact and separation mechanism moved to the separation position, and corrects the charging voltage based on results of measurement of the surface potentials obtained at the contact position and the separation position, thus controlling the back contrast. Since this control operation enables directly measuring the surface potential of the photosensitive drum 1 and detecting a difference value between the surface potentials obtained at the contact position and the separation position, it is possible to maintain a desired back contrast by previously performing addition of the attenuated potential component and then performing charging. At that time, in a case where a difference value between the current value obtained at the contact position and the current value obtained at the separation position is a second difference value larger than a first difference value, the control unit 202 makes the absolute value of the charging voltage larger than that in a case where the difference value is the first difference value. According to the above-mentioned control operation, even when discharge products are accumulated on the photosensitive drum 1, frequent removing operations are not needed and good-quality images with no fogging can be continuously printed.

While, in the fourth exemplary embodiment, the charging voltage is corrected to keep the back contrast optimum, the present exemplary embodiment is not limited to this. For example, the developing voltage can be corrected or the dark portion potential Vd obtained after charging by performing weak exposure with use of the exposure unit 3 as in the modification example can be adjusted.

In the fourth exemplary embodiment, the movement speed of the surface of the developing roller 42 is set to the same speed as that used during image formation, but can be set to a movement speed different from the movement speed used during image formation. For example, as in the wide color gamut image forming mode described in the third exemplary embodiment, the circumferential speed ratio of the developing roller 42 to the photosensitive drum 1 can be changed. In the case of changing the circumferential speed ratio, the control unit 202 can directly measure the surface potential of the photosensitive drum 1 for each circumferential speed ratio, feed back the measured surface potential to the charging voltage, and determine the corrected charging voltage for each circumferential speed ratio.

Moreover, when measuring the charging current, the control unit 202 performs control in the following way. The control unit 202 applies the charging voltage to the charging roller 2 while rotating the photosensitive drum 1. First, the control unit 202 forms a developing portion by moving the contact and separation mechanism (not illustrated) to the contact position, and then detects, via a detection unit, the current value flowing to the charging roller 2 at the contact position when the surface of the photosensitive drum 1 having passed through the developing portion arrives at the charging portion. Next, after moving the contact and separation mechanism to the separation position, the control unit 202 detects, via the detection unit, the current value flowing to the charging roller 2 at the separation position. Then, in a case where a difference value between the current value flowing at the contact position and the current value flowing at the separation position is a second difference value larger than a first difference value, the control unit 202 performs control to make the absolute value of the charging voltage larger than that in a case where the difference value is the first difference value.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-184612 filed Sep. 28, 2018, which is hereby incorporated by reference herein in its entirety.

What is claimed is:

1. An image forming apparatus comprising:

an image bearing member configured to be rotatable;

a charging member configured to form a charging portion while being in contact with the image bearing member and to electrically charge a surface of the image bearing member at the charging portion;

an exposure unit configured to expose, with a first exposure amount, a non-image forming portion, in which a toner image is not formed, in an image formable area of the surface of the image bearing member electrically charged by the charging member, and expose, with a second exposure amount, an image forming portion, in which the toner image is formed, in the image formable area, the first exposure amount being smaller than the second exposure amount;

a developing member configured to form a developing portion while being in contact with the image bearing member and to develop the toner image by supplying toner to the image forming portion at the developing portion;

a charging voltage application unit configured to apply a charging voltage to the charging member;

a current detection unit configured to detect a current value of a current flowing from the image bearing member to the charging member in a state in which the charging voltage is applied at a predetermined value to the charging member; and a control unit configured to control the exposure unit, wherein, in a case where the current value detected by the current detection unit is a second current value larger than a first current value, the control unit controls the exposure unit to expose the surface of the image bearing member with the first exposure amount during image formation smaller than that in a case where the detected current value is the first current value.

2. The image forming apparatus according to claim 1, wherein the image forming apparatus includes a first image forming mode and a second image forming mode which is larger in a circumferential speed difference between a movement speed of the surface of the image bearing member and a movement speed of the surface of the developing member at the developing portion than the first image forming mode, and wherein, when the image forming apparatus performs the second image forming mode, the control unit controls the exposure unit to perform image formation with the first exposure amount smaller than that when the image forming apparatus performs the first image forming mode.

3. The image forming apparatus according to claim 1, wherein, in a case where the current value detected by the current detection unit is the second current value, which is larger than the first current value, the control unit controls the charging voltage application unit to perform image formation by applying the charging voltage at an absolute value which is greater than an absolute value of the charging voltage applied in a case where the detected current value is the first current value.

4. The image forming apparatus according to claim 3, wherein the image forming apparatus includes a first image forming mode and a second image forming mode which is larger in a circumferential speed difference between a movement speed of the surface of the image bearing member and a movement speed of the surface of the developing member at the developing portion than the first image forming mode, and wherein, when the image forming apparatus performs the second image forming mode, the control unit controls the charging voltage application unit to perform image formation by applying the charging voltage an absolute value of which is larger than that when the image forming apparatus performs the first image forming mode.

5. The image forming apparatus according to claim 1, wherein the current detection unit detects the current value in a state in which the charging voltage is applied at a predetermined value lower than a discharge start voltage to the charging member and the image bearing member is rotated.

6. The image forming apparatus according to claim 1, further comprising a developing voltage application unit configured to apply a developing voltage to the developing member, wherein, in a case where the current value detected by the current detection unit is the second current value, the control unit controls the developing voltage application unit to perform image formation by applying the developing voltage at an absolute value which is greater than an absolute value of the developing voltage applied in a case where the detected current value is the first current value.

7. The image forming apparatus according to claim 1, further comprising a transfer member configured to form a transfer portion in cooperation with the image bearing member and to transfer the toner image from the image bearing member to a transfer receiving member at the transfer portion, wherein toner remaining on the image bearing member after the toner image is transferred to the transfer receiving member is recovered by the developing member.

8. The image forming apparatus according to claim 1, further comprising a contact and separation unit configured to move at the developing portion between a contact position in which the developing member is in contact with the image bearing member and a separation position in which the developing member is separate from the image bearing member, wherein the control unit applies the charging voltage to the charging member while rotating the image bearing member, wherein, after the developing portion is formed with the contact and separation unit moved to the contact position, the control unit detects, via the current detection unit, a current value flowing to the charging member at the contact position when the surface of the image bearing member having passed through the developing portion arrives at the charging portion, and, with the contact and separation unit moved to the separation position, the control unit detects, via the current detection unit, a current value flowing to the charging member at the separation position, and wherein, in a case where a difference value between the current value flowing at the contact position and the current value flowing at the separation position is a second difference value larger than a first difference value, the control unit controls the exposure unit to perform image formation with the first exposure amount smaller than that in a case where the difference value is the first difference value.

9. The image forming apparatus according to claim 1, wherein the toner is a one-component developer.

* * * * *